US009863677B2

(12) United States Patent
Yoshikawa et al.

(10) Patent No.: US 9,863,677 B2
(45) Date of Patent: Jan. 9, 2018

(54) SUBLIMATION DEFROST SYSTEM AND SUBLIMATION DEFROST METHOD FOR REFRIGERATION APPARATUS

(71) Applicant: MAYEKAWA MFG. CO., LTD., Tokyo (JP)

(72) Inventors: Choiku Yoshikawa, Tokyo (JP); Takeshi Kamimura, Tokyo (JP); Takahiro Furudate, Tokyo (JP); Shuji Fukano, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 201 days.

(21) Appl. No.: 14/904,283

(22) PCT Filed: Nov. 25, 2014

(86) PCT No.: PCT/JP2014/081044
§ 371 (c)(1),
(2) Date: Jan. 11, 2016

(87) PCT Pub. No.: WO2015/093235
PCT Pub. Date: Jun. 25, 2015

(65) Prior Publication Data

US 2016/0187041 A1 Jun. 30, 2016

(30) Foreign Application Priority Data

Dec. 17, 2013 (JP) ..... 2013-259751

(51) Int. Cl.
*F25B 41/00* (2006.01)
*F25B 47/02* (2006.01)
(Continued)

(52) U.S. Cl.
CPC ..... *F25B 47/02* (2013.01); *F25B 1/10* (2013.01); *F25B 7/00* (2013.01); *F25B 9/00* (2013.01);
(Continued)

(58) Field of Classification Search
CPC ..... F25B 47/02; F25B 49/02; F25B 9/008; F25B 9/00; F25B 41/00; F25B 41/04;
(Continued)

(56) References Cited

U.S. PATENT DOCUMENTS 3,084,519 A 4/1963 Hanson et al.
3,228,204 A 1/1966 Matthies
(Continued)

FOREIGN PATENT DOCUMENTS

CA 2662986 A1 10/2009
DE 2503303 A1 8/1975
(Continued)

OTHER PUBLICATIONS

U.S. Appl. No. 14/767,635, filed Aug. 13, 2015.
(Continued)

*Primary Examiner* — Len Tran
*Assistant Examiner* — Ana Vazquez
(74) *Attorney, Agent, or Firm* — Rossi, Kimms & McDowell LLP

(57) ABSTRACT

A sublimation defrost system for a refrigeration apparatus including: a cooling device in a freezer, and includes a casing containing a heat exchanger pipe; a refrigerating device for cooling and liquefying a $CO_2$ refrigerant; and a refrigerant circuit connected to the heat exchanger pipe permitting the cooled and liquefied $CO_2$ refrigerant to circulate. The defrost system includes: a dehumidifier device; a $CO_2$ circulation path in the heat exchanger pipe, an on-off valve in the heat exchanger; a circulating unit for the $CO_2$
(Continued)

refrigerant; a first heat exchanger part exchanging heat between a brine as a first heating medium and the circulating $CO_2$ refrigerant; and a pressure adjusting unit for the circulating $CO_2$ refrigerant during defrosting so that a condensing temperature of the $CO_2$ refrigerant becomes equal to or lower than a freezing point of a water vapor in the freezer inner air without a drain receiving unit.

15 Claims, 9 Drawing Sheets

(51) Int. Cl.

| | |
|---|---|
| ***F25D 17/02*** | (2006.01) |
| ***F25B 1/10*** | (2006.01) |
| ***F25B 7/00*** | (2006.01) |
| ***F25D 21/10*** | (2006.01) |
| ***F25B 9/00*** | (2006.01) |
| ***F25B 41/04*** | (2006.01) |
| ***F25B 49/02*** | (2006.01) |
| ***F25D 21/12*** | (2006.01) |
| ***F25D 21/14*** | (2006.01) |
| *F25B 25/00* | (2006.01) |
| *F25B 23/00* | (2006.01) |

(52) U.S. Cl.
CPC ..... *F25B 9/008* (2013.01); *F25B 41/00* (2013.01); *F25B 41/04* (2013.01); *F25B 49/02* (2013.01); *F25D 17/02* (2013.01); *F25D 21/10* (2013.01); *F25D 21/12* (2013.01); *F25D 21/14* (2013.01); *F25B 23/006* (2013.01); *F25B 25/00* (2013.01); *F25B 2339/047* (2013.01); *F25B 2347/022* (2013.01); *F25B 2400/072* (2013.01); *F25B 2400/13* (2013.01)

(58) Field of Classification Search
CPC ..... F25B 7/00; F25B 1/10; F25B 2347/022; F25B 23/006; F25B 2339/047; F25B 25/00; F25B 2400/13; F25B 2400/072; F25D 21/14; F25D 21/12; F25D 21/10; F25D 17/02
See application file for complete search history.

(56) References Cited

U.S. PATENT DOCUMENTS

| | | | |
|---|---|---|---|
| 6,170,270 | B1 | 1/2001 | Arshansky et al. |
| 7,698,902 | B2 | 4/2010 | Kang et al. |
| 7,992,397 | B2 | 8/2011 | Nemoto et al. |
| 2006/0266058 | A1 | 11/2006 | Nemoto et al. |
| 2007/0234753 | A1 | 10/2007 | Nemoto et al. |
| 2009/0260389 | A1 | 10/2009 | Dube |
| 2012/0055182 | A1 | 3/2012 | Dube |
| 2012/0055185 | A1 | 3/2012 | Luo et al. |
| 2013/0098078 | A1 | 4/2013 | Contreras Lafaire et al. |
| 2014/0260361 | A1 | 9/2014 | Rodier |
| 2014/0352343 | A1 | 12/2014 | Hinde et al. |
| 2015/0204589 | A1 | 7/2015 | Liu |

FOREIGN PATENT DOCUMENTS

| | | | |
|---|---|---|---|
| DE | 29817062 | U1 | 4/1999 |
| EP | 1630495 | A1 | 3/2006 |
| JP | 5244468 | U | 3/1977 |
| JP | 52131652 | U | 10/1977 |
| JP | 2001027473 | A | 1/2001 |
| JP | 2003021365 | A | 1/2003 |
| JP | 2003329334 | A | 11/2003 |
| JP | 2004170007 | A | 6/2004 |
| JP | 4197562 | B2 | 10/2008 |
| JP | 2010181093 | A | 8/2010 |
| JP | 2012072981 | A | 4/2012 |
| JP | 2013124812 | A | 6/2013 |
| JP | 2013160427 | A | 8/2013 |
| JP | 5316973 | B2 | 10/2013 |
| KR | 2019940008247 | U | 4/1994 |
| KR | 1020110021128 | A | 3/2011 |
| WO | 2006049355 | A1 | 5/2006 |
| WO | 2008112554 | A1 | 9/2008 |
| WO | 2009034300 | A1 | 3/2009 |

OTHER PUBLICATIONS

U.S. Appl. No. 14/903,870, filed Jan. 8, 2016.
International Preliminary Report on Patentability issued in Intl. Appln. No. PCT/JP2014/081042 dated Jun. 21, 2016. English translation provided.
International Preliminary Report on Patentability issued in Intl. Appln. No. PCT/JP2014/081043 dated Jun. 21, 2016. English translation provided.
International Preliminary Report on Patentability issued in Intl. Appln. No. PCT/JP2014/081044 dated Jun. 21, 2016. English translation provided.
Extended European Search Report issued in European Appln. No. 14873060.9, dated Oct. 28, 2016.
Extended European Search Report issued in European Appln. No. 14871996.6, dated Oct. 28, 2016.
Office Action issued in Korean Appln. No. 10-2016-7019058 dated Apr. 10, 2017. English translation provided.
Office Action issued in Korean Appln. No. 10-2016-7019012 dated Apr. 10, 2017. English translation provided.
Office Action issued in Korean Appln. No. 10-2016-7018741 dated Apr. 10, 2017. English translation provided.
International Search Report issued in PCT/JP2014/081042 dated Feb. 24, 2015. English translation provided.
Written Opinion issued in PCT/JP2014/081042 dated Feb. 24, 2015.
International Search Report issued in PCT/JP2014/081043, dated Feb. 24, 2015. English translation provided.
Written Opinion issued in PCT/JP2014/081043, dated Feb. 24, 2015.
Notice of Allowance issued in U.S. Appl. No. 14/903,870 dated Jun. 16, 2017.
Scientific & Technical Information Center (STIC) EIC 3700 Search Report—Retrieved Jun. 2017.
International Search Report issued in PCT/JP2014/081044, dated Feb. 24, 2015. English translation provided.
Written Opinion issued in PCT/JP2014/081044, dated Feb. 24, 2015.

SUBLIMATION DEFROST SYSTEM AND SUBLIMATION DEFROST METHOD FOR REFRIGERATION APPARATUS

TECHNICAL FIELD

The present disclosure relates to a sublimation defrost system and sublimation defrost method in which frost attached to a heat exchanger pipe disposed in a cooling device is removed through sublimation without melting the frost, the system and the method applied to a refrigeration apparatus in which a $CO_2$ refrigerant is permitted to circulate in the cooling device disposed in a freezer for cooling inside the freezer.

BACKGROUND

To prevent the ozone layer depletion, global warming, and the like, natural refrigerants such as $NH_3$ or $CO_2$ have been reviewed as a refrigerant in a refrigeration apparatus used for room air conditioning and refrigerating food products. Thus, refrigeration apparatuses using $NH_3$, with high cooling performance and toxicity, as a primary refrigerant and using $CO_2$, with no toxicity or smell, as a secondary refrigerant have been widely used.

In the refrigeration apparatus, a primary refrigerant circuit and a secondary refrigerant circuit are connected to each other through a cascade condenser. Heat exchange between the $NH_3$ refrigerant and the $CO_2$ refrigerant takes place in the cascade condenser. The $CO_2$ refrigerant cooled and liquefied with the $NH_3$ refrigerant is sent to a cooling device disposed in the freezer, and cools air in the freezer through a heat transmitting pipe disposed in the cooling device. The $CO_2$ refrigerant partially vaporized therein returns to the cascade condenser through the secondary refrigerant circuit, to be cooled and liquefied again in the cascade condenser.

Frost attaches to a heat exchanger pipe disposed in the cooling device while the refrigeration apparatus is under operation, and thus the heat transmission efficiency degrades. Thus, the operation of the refrigeration apparatus needs to be periodically stopped, to perform defrosting.

Conventional defrost methods for the heat exchanger pipe disposed in the cooling device include a method of spraying water onto the heat exchanger pipe, a method of heating the heat exchanger pipe with an electric heater, and the like. The defrosting by spraying water ends up producing a new source of frost, and the heating by the electric heater is against an attempt to save power because valuable power is wasted. In particular, the defrosting by spraying water requires a tank with a large capacity and water supply and discharge pipes with a large diameter, and thus increases plant construction cost.

Patent Documents 1 and 2 disclose a defrost system for the refrigeration apparatus described above. A defrost system disclosed in Patent Document 1 is provided with a heat exchanger part unit which vaporizes the $CO_2$ refrigerant with heat produced in the $NH_3$ refrigerant, and achieves the defrosting by permitting $CO_2$ hot gas generated in the heat exchanger part unit to circulate in the heat exchanger pipe in the cooling device.

A defrost system disclosed in Patent Document 2 is provided with a heat exchanger part unit which heats the $CO_2$ refrigerant with cooling water that has absorbed exhaust heat from the $NH_3$ refrigerant, and achieves the defrosting by permitting the heated $CO_2$ refrigerant to circulate in the heat exchanger pipe in the cooling device.

Patent Document 3 discloses a method of providing a heating tube in the cooling device separately and independently from a cooling tube, and melts and removes the frost attached to the cooling tube by permitting warm water or warm brine to flow in the heating tube at the time of a defrosting operation.

One ideal defrost method involves sublimation defrosting. In this method, a surface of the heat exchanger pipe is uniformly heated at a temperature not higher than 0° C., that is, without turning the frost into water, so that the frost is removed from the surface of the heat exchanger pipe through sublimation. This method involves no drainage, and thus requires no drain pan or discharge facility, and thus can largely reduce a facility cost.

The applicants have proposed a method of first cooling the freezer inner air to a temperature at or below 0° C., and removing frost attached to the heat exchanger pipe of the cooling device, in a low water vapor atmosphere achieved by dehumidification, by an adsorption dehumidifier device through sublimation (Patent Document 4).

CITATION LIST

Patent Literature

Patent Document 1: Japanese Patent Application Laid-open No. 2010-181093

Patent Document 2: Japanese Patent Application Laid-open No. 2013-124812

Patent Document 3: Japanese Patent Application Laid-open No. 2003-329334

Patent Document 3: Japanese Patent Application Laid-open No. 2012-072981

SUMMARY

Technical Problem

Each of the defrost systems disclosed in Patent Documents 1 and 2 requires the pipes for the $CO_2$ refrigerant and the $NH_3$ refrigerant in a system different from the cooling system to be constructed at the installation site, and thus might increase the plant construction cost. The heat exchanger part unit is separately installed outside the freezer, and thus an extra space for installing the heat exchanger part unit is required.

In the defrost system in Patent Document 2, a pressurizing/depressurizing adjustment unit is required to prevent thermal shock (sudden heating/cooling) in the heat exchanger pipe. To prevent the heat exchanger part unit, where the cooling water and the $CO_2$ refrigerant exchange heat, from freezing, an operation of discharging the cooling water in the heat exchanger part unit needs to be performed after the defrosting operation is terminated. Thus, there is a problem in that, for example, an operation is complicated.

The defrost unit disclosed in Patent Document 3 has a problem in that the heat transmission efficiency is low because the cooling tube is heated from the outside with plate fins and the like.

Furthermore, in a cascade refrigerating device including: a primary refrigerant circuit in which the $NH_3$ refrigerant circulates and a refrigerating cycle component is provided; and a secondary refrigerant circuit in which the $CO_2$ refrigerant circulates and a refrigerating cycle component is disposed, the secondary refrigerant circuit being connected to the primary refrigerant circuit through a cascade condenser, the secondary refrigerant circuit contains $CO_2$ gas with high temperature and high pressure. Thus, the defrosting can be achieved by permitting the $CO_2$ hot gas to circulate in the heat exchanger pipe in the cooling device. However, the cascade refrigerating device has the following problems. Specifically, the device is complicated and involves high cost because selector valves, branch pipes, and the like are provided. Furthermore, a control system is unstable due to high/low temperature heat balance.

In the sublimation defrosting described above, the frost on the surface of the heat exchanger pipe needs to be uniformly heated at a temperature not higher than 0° C. However, it is difficult to uniformly heat the heat exchanger pipe at a temperature not higher than 0° C. with a general heating method employed in the defrost method disclosed in Patent Document 4. Thus, the sublimation defrosting has not been put into practice.

The present invention is made in view of the problem described above, and an object of the present invention is to achieve reduction of initial and running costs required for a refrigeration apparatus and power saving, by implementing the sublimation defrost method described above.

Solution to Problem

A defrost system according to at least one embodiment of the present invention is:

(1) A sublimation defrost system for a refrigeration apparatus including: a cooling device which is disposed in a freezer, and includes a casing and a heat exchanger pipe disposed in the casing; a refrigerating device for cooling and liquefying a $CO_2$ refrigerant; and a refrigerant circuit which is connected to the heat exchanger pipe and which is configured to permit the $CO_2$ refrigerant cooled and liquefied in the refrigerating device to circulate to the heat exchanger pipe, the defrost system including:

a dehumidifier device for dehumidifying freezer inner air in the freezer;

a $CO_2$ circulation path which is formed of a circulation path forming path connected to an inlet path and an outlet path of the heat exchanger pipe, and includes the heat exchanger pipe;

an on-off valve disposed in each of the inlet path and the outlet path of the heat exchanger pipe and configured to be closed at a time of defrosting so that the $CO_2$ circulation path becomes a closed circuit;

a circulating unit for $CO_2$ refrigerant, the circulating unit being disposed in the $CO_2$ circulation path;

a first heat exchanger part configured to cause heat exchange between a brine as a first heating medium and the $CO_2$ refrigerant circulating in the $CO_2$ circulation path; and a pressure adjusting unit which adjusts a pressure of the $CO_2$ refrigerant circulating in the closed circuit at the time of defrosting so that a condensing temperature of the $CO_2$ refrigerant becomes equal to or lower than a freezing point of a water vapor in the freezer inner air in the freezer, in which the defrosting is able to be achieved without a drain receiving unit.

In the configuration (1), when the defrosting is performed, when the freezer inner air in the freezer has saturated water vapor pressure, the freezer inner air is first dehumidified by the dehumidifier device, so that the water vapor partial pressure is reduced. Then, the on-off valve is closed so that the $CO_2$ circulation path becomes the closed circuit.

Then, the pressure adjusting unit adjusts the pressure of the $CO_2$ refrigerant circulating in the closed circuit so that the condensing temperature of the $CO_2$ refrigerant becomes equal to or lower than a freezing point of the water vapor in the freezer inner air in the freezer. Then, the $CO_2$ refrigerant is permitted to circulate in the closed circuit by the circulating unit.

For example, the circulating unit is a liquid pump disposed in the $CO_2$ circulation path for permitting a liquid $CO_2$ refrigerant to circulate in the closed circuit, and the like. For example, the pressure adjusting unit includes a pressure sensor which detects the pressure of the $CO_2$ refrigerant or a unit which detects the temperature of the $CO_2$ refrigerant and obtains the pressure of the $CO_2$ refrigerant based on the saturated pressure of the $CO_2$ refrigerant corresponding to the temperature detection value.

Then, a warm brine as a heating medium heats the $CO_2$ refrigerant circulating in the closed circuit in the first heat exchanger part, whereby the $CO_2$ refrigerant is vaporized. Then, the vaporized $CO_2$ refrigerant is circulated in the closed circuit. Thus, the frost attached to the outer surface of the heat exchanger pipe is removed through sublimation by the heat of the $CO_2$ refrigerant gas. The $CO_2$ refrigerant that has imparted heat to the frost is liquefied, and then is heated and vaporized again in the first heat exchanger part.

The "freezer" includes a refrigerator and anything that forms other cooling spaces. The inlet path and the outlet path of the heat exchanger pipe are areas of the heat exchanger pipe disposed in the freezer. The areas extend from a range around a partition wall of the casing of the cooling device to the outer side of the casing.

The conditions required for the sublimation of the frost attached to the outer surface of the heat exchanger pipe are (1) the water vapor partial pressure of the freezer inner air is not as high as saturated water vapor pressure, and (2) the temperature of the frost is equal to or lower than the freezing point. As a preferable but not required condition, (3) sublimated water vapor is dissipated by forming airflow on the outer surface of the heat exchanger part. The frost can be sublimated by heating the frost under these conditions.

In the configuration (1), the frost attached to the outer surface of the heat exchanger pipe is heated with the heat of the $CO_2$ refrigerant flowing in the heat exchanger pipe. Thus, the entire area of the heat exchanger pipe can be uniformly heated. The pressure in the closed circuit is adjusted, so that the condensing temperature of the $CO_2$ refrigerant is controlled. Thus, the temperature of the $CO_2$ refrigerant gas flowing in the can be accurately controlled. Thus, the frost can be accurately heated to a temperature at or below the freezing point, whereby the sublimation defrosting can be achieved.

The frost attached to the heat exchanger pipe is not melted but is sublimated, and thus a drain pan and a facility for discharging the drainage accumulated in the drain pan are not required, whereby the cost of the refrigeration apparatus can be largely reduced. The frost attached to the heat exchanger pipe is heated from the inside through a pipe wall of the heat exchanger pipe only. Thus, the heat exchange efficiency can be improved and power saving can be achieved.

The defrosting can be achieved with the $CO_2$ refrigerant in a low pressure state corresponding to the condensing temperature equal to or lower than the freezing point of the water vapor in the freezer. Thus, a pipe system device such as the $CO_2$ circulation path needs not to be pressure resistant, whereby a high cost is not required.

In some embodiments, in the configuration (1), (2) the circulation path forming path is a defrost circuit branched from the inlet path and the outlet path of the heat exchanger pipe, and the heat exchanger part is formed in the defrost circuit.

In the configuration (2), the defrost circuit is provided, whereby a portion where the first heat exchanger part is installed can be more freely determined.

In some embodiments, in the configuration (1), (3) the circulation path forming path is a bypass path disposed between the inlet path and the outlet path of the heat exchanger pipe, and The first heat exchanger part is formed in a partial area of the heat exchanger pipe.

In the configuration (3), the $CO_2$ circulation path is formed of the heat exchanger pipe only, except for the bypass path. Thus, there is no need to additionally provide new pipes for forming the $CO_2$ circulation path, except for the bypass path, whereby a high cost is not required.

In some embodiments, in any one of configurations (1) to (3), (4) the $CO_2$ circulation path is formed with a difference in elevation, and the first heat exchanger part is formed in a lower area of the $CO_2$ circulation path, and the circulating unit is configured to permit the $CO_2$ refrigerant to naturally circulate in the closed circuit at the time of defrosting by a thermosiphon effect.

In the configuration (4), the $CO_2$ refrigerant in the lower area of the heat exchanger pipe is heated by the brine as the heating medium to be vaporized in the first heat exchanger part. The vaporized $CO_2$ refrigerant is permitted to rise in the closed circuit by the thermosiphon effect. The $CO_2$ refrigerant that has rose to the upper area of the closed circuit heats and removes the frost attached to the outer surface of the heat exchanger pipe through sublimation, and then is liquefied. The liquefied $CO_2$ refrigerant descends by the gravity.

In the configuration (4), the $CO_2$ refrigerant can be permitted to naturally circulate in the closed circuit by the thermosiphon effect. Thus, a unit for forcibly circulating the $CO_2$ refrigerant in the closed circuit is not required, and equipment and power for forcing circulation are not required, whereby cost reduction can be achieved.

In some embodiments, any one of the configurations (1) to (4) further includes:

(5) a second heat exchanger part for heating the brine with a second heating medium; and a brine circuit for permitting the brine heated by the second heating unit to be circulated to the first heating unit, the brine circuit being connected to the first heating unit and the second heating unit.

Any heating medium other than the cooling water can be used as the second heating medium. Such a heating medium includes, for example, refrigerant gas with high temperature and high pressure discharged from the compressor forming the refrigerating device, warm discharge water from a factory, a medium that has absorbed heat emitted from a boiler or potential heat of an oil cooler, and the like.

In the configuration (5), the second heat exchanger part and the brine circuit are provided, whereby the heated brine can be supplied to the first heat exchanger part, and the brine circuit can be disposed in accordance with a disposed position of the first heat exchanger part. Thus, a position where the heat exchanger part is disposed can be more freely determined.

In some embodiments, in the configuration (5), (6) the heat exchanger pipe is provided with a difference in elevation in the cooling device, the brine circuit is formed in the cooling device and in a lower area of the heat exchanger pipe, and the first heat exchanger part is formed between the brine circuit and the lower area of the heat exchanger pipe.

In the configuration (6), the frost attached to the outer surface of the heat exchanger pipe can be removed through sublimation with the $CO_2$ refrigerant vaporized in the lower area of the heat exchanger pipe permitted to naturally circulate by the thermosiphon effect. Thus, no additional pipes other than the heat exchanger pipe are required, and no equipment for forcing circulation of the $CO_2$ refrigerant is required. All things considered, the cost of the cooling device can be reduced.

The brine branch circuit is not disposed in the upper area of the heat exchanger pipe, whereby the power used for the fan for forming airflow in the cooling device can be reduced. The cooling performance of the cooling device can be improved by additionally providing the heat exchanger pipe in a vacant space in the upper area.

In some embodiments, in the configuration (5), (7) each of the heat exchanging pipe and the brine circuit is provided with a difference in elevation in the cooling device and is configured in such a manner that the brine flows from a lower side to an upper side in the brine circuit, and a flowrate adjustment valve is disposed at an intermediate position in the brine circuit in an upper and lower direction, and the first heat exchanger part is formed at a portion of the brine circuit on an upstream side of the flowrate adjustment valve.

In the configuration (7), the brine flowrate is regulated by the flowrate adjustment valve, and the flowrate of the brine flowing into the upper area of the brine circuit is regulated. Thus, the first heat exchanger part can be formed only in the lower area of the heat exchanger pipe. Thus, as in the configuration (6), the frost attached can be removed through sublimation with the $CO_2$ refrigerant permitted to naturally circulate by the thermosiphon effect Thus, the frost attached to the heat exchanger pipe cane be removed through sublimation even in a known cooling device in which a heating tube for circulating the warm brine is disposed across the entire area of the heat exchanger pipe in the upper and lower direction such as the cooing device disclosed in Patent Document 3, with a simple arrangement of adding the flowrate adjustment valve to the heat exchanger pipe In some embodiments, the configuration (5) further includes:

(8) a first temperature sensor and a second temperature sensor which are respectively disposed at an inlet and an outlet of the brine circuit to detect a temperature of the brine flowing through the inlet and the outlet.

In the configuration (8), a small difference between the detected values of the two temperature sensors indicates that the melted amount of the frost is reduced, and the defrosting is almost completed. The timing at which the defrosting operation is completed can be accurately determined by obtaining the difference between the detected values of the two temperature sensors because sensible heating is performed in the heat exchanger part with the brine.

Thus, excessive heating in the freezer or diffusion of the water vapor due to the excessive heating can be prevented, and further power saving can be achieved. Furthermore, a stable temperature in the freezer can be achieved, whereby the quality of food products frozen in the freezer can be improved.

In some embodiments, in the configuration (1), (9) the pressure adjusting unit includes:

a pressure sensor for detecting the pressure of the $CO_2$ refrigerant circulating in the closed circuit;

a pressure adjusting valve disposed in the outlet path of the heat exchanger pipe; and a control device for receiving a detected value from the pressure sensor, and controlling an opening aperture of the pressure adjusting valve in such a manner that the condensing temperature of the $CO_2$ refrigerant circulating in the closed circuit becomes equal to or lower than the freezing point of the water vapor in the freezer inner air in the freezer.

In the configuration (9), the control device can accurately control the pressure of the $CO_2$ refrigerant circulating in the closed circuit.

In some embodiments, in the configuration (1),

(10) the refrigerating device includes:

a primary refrigerant circuit in which $NH_3$ refrigerant circulates and a refrigerating cycle component is disposed;

a secondary refrigerant circuit in which the $CO_2$ refrigerant circulates, the secondary refrigerant circuit led to the cooling device, the secondary refrigerant circuit being connected to the primary refrigerant circuit through a cascade condenser; and a liquid $CO_2$ receiver for storing the $CO_2$ refrigerant liquefied in the cascade condenser and a liquid $CO_2$ pump for sending the $CO_2$ refrigerant stored in the liquid.

In the configuration (10), in the refrigerating device, natural refrigerants of $NH_3$ and $CO_2$ are used, and thus an attempt to prevent the ozone layer depletion, global warming, and the like is facilitated. Furthermore, the refrigerating device uses $NH_3$, with high cooling performance and toxicity, as a primary refrigerant and uses $CO_2$, with no toxicity or smell, as a secondary refrigerant, and thus can be used for room air conditioning and for refrigerating food products and the like, while maintaining higher cooling performance.

In some embodiments, in the configuration (1),

(11) the refrigerating device is a $NH_3/CO_2$ cascade refrigerating device including:

a primary refrigerant circuit in which $NH_3$ refrigerant circulates and a refrigerating cycle component is disposed; and a secondary refrigerant circuit in which the $CO_2$ refrigerant circulates and a refrigerating cycle component is disposed, the secondary refrigerant circuit led to the cooling device, the secondary refrigerant circuit being connected to the primary refrigerant circuit through a cascade condenser.

In the configuration (11), in the refrigerating device, the natural refrigerant is used, and thus an attempt to prevent the ozone layer depletion, global warming, and the like is facilitated. Furthermore, the refrigerating device uses $CO_2$, with no toxicity or smell, as a secondary refrigerant, and thus can be used for room air conditioning and for refrigerating food products and the like while maintaining high cooling performance. The refrigerating device is a cascade refrigerating device, and thus can have higher COP.

In some embodiments, the configuration (10) or (11) further includes:

a cooling water circuit led to a condenser provided as a part of the refrigerating cycle component disposed in the primary refrigerant circuit, and the second heat exchanger part is a heat exchanger part to which the cooling water circuit and the brine circuit are led, the heat exchanger part configured to heat the brine circulating in the brine circuit with cooling water heated by the condenser.

In the configuration (12), the brine can be heated with the heated cooling water, and thus no heating source outside the refrigeration apparatus is required.

The temperature of the cooling water can be lowered by the brine during the defrosting operation, whereby the condensing temperature of the $NH_3$ refrigerant during the refrigerating operation can be lowered, and the COP of the refrigerating device can be improved.

In an example embodiment where the cooling water circuit is disposed between the condenser and a cooling tower, the second heat exchanger part can be disposed in the cooling tower. Thus, a space where the device used for the defrosting can be downsized.

In some embodiments the configuration (10) or (11) further includes:

(13) a cooling water circuit led to a condenser provided as a part of the refrigerating cycle component disposed in the primary refrigerant circuit; and a cooling tower for cooling the cooling water circulating in the cooling water circuit by exchanging heat between the cooling water and spray water, and the second heat exchanger part includes a heating tower for receiving the spray water and exchanging heat between the brine circulating in the brine circuit and the spray water, the heating tower being integrally formed with the cooling tower.

In the configuration (13), the heating tower is integrally formed with the cooling tower, whereby a space in which the second heat exchanger part is installed can be downsized.

(14) A sublimation defrost method according to at least one embodiment of the present invention includes:

a first step of dehumidifying the freezer inner air in the freezer with the dehumidifier device so that a partial pressure of the water vapor in the freezer inner air does not become a saturated vapor partial pressure;

a second step of closing the on-off valve at the time of defrosting to form the closed circuit;

a third step of adjusting the pressure of the $CO_2$ refrigerant circulating in the closed circuit so that the condensing temperature of the $CO_2$ refrigerant becomes equal to or lower than the freezing point of the water vapor in the freezer inner air in the freezer; and a fourth step of vaporizing the $CO_2$ refrigerant by exchanging heat between the brine as a heating medium and the $CO_2$ refrigerant circulating in the closed circuit; and a fifth step of permitting the $CO_2$ refrigerant vaporized in the fourth step to circulate in the closed circuit, and removing frost attached on an outer surface of the heat exchanger pipe by sublimation with heat of the $CO_2$ refrigerant.

In the configuration (14), the frost attached to the outer surface of the heat exchanger pipe is heated by the heat of the $CO_2$ refrigerant flowing in the heat exchanger pipe, and thus the entire area of the heat exchanger pipe can be uniformly heated. The pressure in the closed circuit is adjusted, so that the condensing temperature of the $CO_2$ refrigerant is controlled, whereby the temperature of the $CO_2$ refrigerant gas flowing in the closed circuit can be accurately controlled. Thus, the frost can be accurately heated to a temperature equal to or lower than the freezing point, whereby the sublimation defrosting can be achieved.

As described above, the frost attached to the heat exchanger pipe is not melted but is sublimated, and thus a drain pan and a facility for discharging the drainage accumulated in the drain pan are not required, whereby the cost of the refrigeration apparatus can be largely reduced. The frost attached to the heat exchanger pipe is heated from the inside through a pipe wall of the heat exchanger pipe only.

Thus, the heat exchange efficiency can be improved and power saving can be achieved.

In some embodiments, in the configuration (14)

(15) in the fourth step, the brine and the $CO_2$ refrigerant circulating in the closed circuit exchange heat in the lower area of the closed circuit provided with a difference in elevation, and in the fifth step, the $CO_2$ refrigerant is permitted to naturally circulate in the closed circuit by a thermosiphon effect.

In the configuration (15), the $CO_2$ refrigerant is permitted to naturally circulate in the closed circuit by the thermosiphon effect, whereby a unit for forcing circulation of the $CO_2$ refrigerant is not required, and the cost reduction can be achieved.

Advantageous Effects

According to at least one embodiment of the present invention, sublimation defrosting of the frost attached to the surface of the heat exchanger pipe of the cooling device can be achieved. Thus, the drain pan and a drainage discharge facility are not required. Furthermore, no drain discharging operation is required, whereby initial and running costs required for the defrosting can be reduced, and the power saving can be achieved.

DETAILED DESCRIPTION

Figure 1:
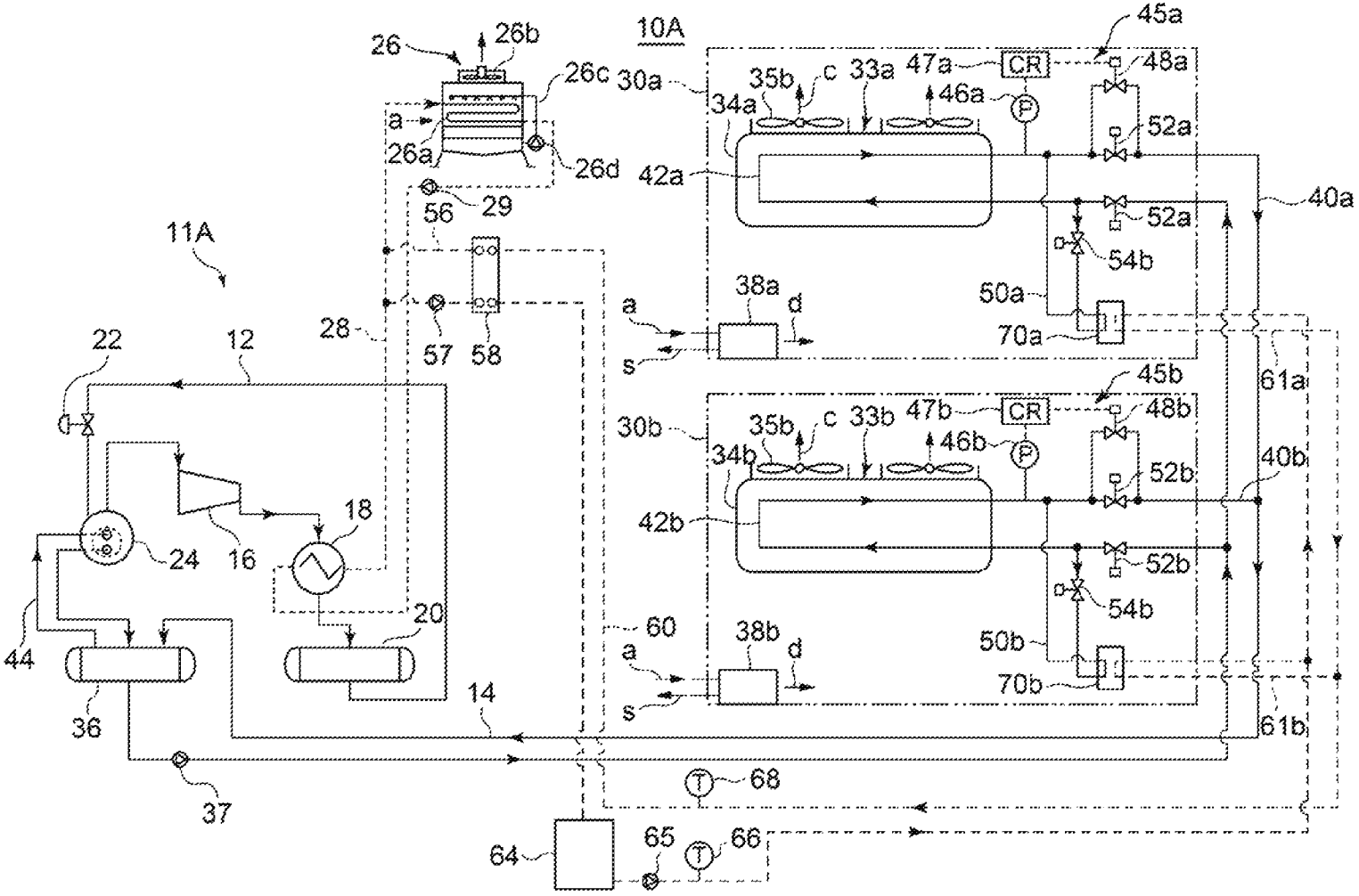
FIG. 1 is a system diagram of a refrigeration apparatus according to one embodiment.

Embodiments of the present invention shown in the accompanying drawings will now be described in detail. It is intended, however, that dimensions, materials, shapes, relative positions, and the like of components described in the embodiments shall be interpreted as illustrative only and not limitative of the scope of the present invention unless otherwise specified.

For example, expressions indicating a relative or absolute arrangement such as "in a certain direction", "along a certain direction", "parallel to", "orthogonal to", "center of", "concentric to", and "coaxially" do not only strictly indicate such arrangements but also indicate a state including a tolerance or a relative displacement within an angle and a distance achieving the same function.

For example, expressions such as "the same", "equal to", and "equivalent to" indicating a state where the objects are the same, do not only strictly indicate the same state, but also indicate a state including a tolerance or a difference achieving the same function For example, expressions indicating shapes such as rectangular and cylindrical do not only indicate the shapes such as rectangular and cylindrical in a geometrically strict sense, but also indicate shapes including recesses/protrusions, chamfered portions, and the like, as long as the same effect can be obtained.

Expressions such as "comprising", "including", "includes", "provided with", or "having" a certain component are not exclusive expressions that exclude other components.

FIG. 1 to FIG. 9 show defrost systems for refrigeration apparatuses according to some embodiments of the present invention.

Refrigeration apparatus 10A to 10D in these embodiments include: cooling devices 33*a* and 33*b* respectively disposed in freezers 30*a* and 30*b*; refrigerating devices 11A and 11B which cool and liquefy $CO_2$ refrigerant; and a refrigerant circuit (corresponding to secondary refrigerant circuit 14) which permits the $CO_2$ refrigerant cooled and liquefied in the refrigerating devices to circulate to the cooling devices 33*a* and 33*b*. The cooling devices 33*a* and 33*b* respectively include: casings 34*a* and 34*b*; and heat exchanger pipes 42*a* and 42*b* disposed in the casings. The internal temperature of the freezers 30*a* and 30*b* is kept as low as −25° C., for example in the refrigeration apparatus 10A to 10D shown in FIG. 1 to FIG. 9 during a refrigerating operation.

In the exemplary configurations of the embodiments, the heat exchanger pipes 42*a* and 42*b* are led into the casings 34*a* and 34*b* from the outside of the casings 34*a* and 34*b*.

Here, areas of heat exchanger pipes 42*a* and 42*b* outside partition walls of the casings 34*a* and 34*b* and inside the freezers 30*a* and 30*b* are referred to as an inlet tube 42*c* and an outlet tube 42*d*.

Dehumidifier devices 38*a* and 38*b* for dehumidifying freezer inner air are disposed in the freezers 30*a* and 30*b*. The dehumidifier devices 38*a* and 38*b* are adsorption dehumidifier devices in some embodiments shown in FIG. 1 to FIG. 9. For example, the adsorption dehumidifier device is a desiccant rotor dehumidifier device including a rotary rotor bearing adsorbent on its surface, and continuously and simultaneously performs a step of adsorbing water vapor from the freezer inner air at a partial area of the rotary rotor and a step of separating the adsorbed water vapor with other areas. Outer air a is supplied to the dehumidifier devices 38*a* and 38*b*. The dehumidifier devices 38*a* and 38*b* adsorb water vapor s and discharged to the outside, and discharges cold dry air d into the freezer.

A $CO_2$ circulation path is formed of a circulation path forming path connected to the inlet tube 42*c* and the outlet tube 42*d* of the heat exchanger pipes 42*a* and 42*b*. The circulation path forming path is defrost circuits 50*a* and 50*b* connected to the inlet tube and the outlet tube of the heat exchanger pipes 42*a* and 42*b* in the embodiments shown in FIG. 1 and FIG. 9, and is bypass tubes 72*a* and 72*b* connected to the inlet tube and the outlet tube of the heat exchanger pipes 42*a* and 42*b* in the embodiments shown in FIG. 2 to FIG. 6.

An on-off valve for making the $CO_2$ circulation path become a closed circuit at the time of defrosting is disposed in each of the inlet tube 42*c* and the outlet tube 42*d* of the heat exchanger pipes 42*a* and 42*b*. In some embodiments shown in FIG. 1 to FIG. 9, the on-off valve is solenoid on-off valves 54*a* and 54*b*.

In the example configurations of the embodiments shown in FIG. 1 to FIG. 9, two air openings are formed on the casings 34*a* and 34*b*. Fans 35*a* and 35*b* are disposed in one of the openings. An airflow flowing in and out of the casings 34*a* and 34*b* is formed by an operation of the fans 35*a* and 35*b*. The heat exchanger pipes 42*a* and 42*b* have a winding shape in a horizontal direction and an upper and lower direction for example.

Pressure adjusting units 45*a* and 45*b* for storage spacing pressure of a $CO_2$ refrigerant circulating in the closed circuit at the time of defrosting are disposed. The pressure of the $CO_2$ refrigerant in the closed circuit is adjusted by the pressure adjusting units 45*a* and 45*b* so that the $CO_2$ refrigerant has condensing temperature higher than a freezing point (for example, 0° C.) of the water vapor in freezer inner air in the freezers 30*a* and 30*b*, at the time of defrosting.

In the example configurations of some embodiments shown in FIG. 1 to FIG. 9, the pressure adjusting units 45*a* and 45*b* respectively include: pressure sensors 46*a* and 46*b* for detecting the pressure of the $CO_2$ refrigerant circulating in the closed circuit; pressure regulating valves 48*a* and 48*b* disposed in the outlet tube 42*d*; and control devices 47*a* and 47*b* which receive detected values from the pressure sensors 46*a* and 46*b*, and control valve apertures of the pressure adjustment valves 48*a* and 48*b* so that the pressure of the $CO_2$ refrigerant is controlled in such a manner that condensing temperature of the $CO_2$ refrigerant circulating in the closed circuit becomes higher than a freezing point of water vapor in the freezer inner air in the freezers 30*a* and 30*b*.

In the example configuration of the embodiment, the pressure regulating valves 48*a* and 48 are disposed in parallel to the solenoid on-off valves 52*a* and 52*b*.

The pressure sensors 46*a* and 46*b* are disposed in the outlet tube 42*d* on the upstream side of the pressure regulating valves 48*a* and 48*b*. The control devices 47*a* and 47*b* controls the opening aperture of the pressure regulating valves 48*a* and 48*b* and thus adjusts the pressure of the $CO_2$ refrigerant in accordance with the detected values from the pressure sensors. Thus, the condensing temperature of the $CO_2$ refrigerant circulating in the closed circuit becomes equal to or lower than the freezing point of the water vapor in the freezer inner air in the freezers 30*a* and 30*b*.

When the solenoid on-off valves 52*a* and 52*b* are closed at the time of defrosting so that the $CO_2$ circulation path becomes a closed circuit, a circulating unit permits the $CO_2$ refrigerant to circulate in the closed circuit. The circulating unit is a liquid pump disposed in the $CO_2$ circulation path for example. Alternatively, the circulating unit may permit the $CO_2$ refrigerant to naturally circulate by a thermosiphon effect as in some embodiments shown in FIG. 1 to FIG. 10, rather than forcing the refrigerant to circulate.

A brine is used as a heating medium. A first heat exchanger part which heats the $CO_2$ refrigerant circulating in the $CO_2$ circulation path with the brine, and thus vaporizes the refrigerant, is disposed. The first heat exchanger part is heat exchanger parts 70*a* and 70*b* to which brine branch circuits 61*a* and 61*b*, branched from defrost circuits 50*a* and 50*b* and a brine circuit 60, are led, in the embodiments shown in FIG. 1 and FIG. 9. The heat exchanger part in the embodiments shown in FIG. 2 to FIG. 6 includes lower areas of the heat exchanger pipes 42*a* and 42*b* and brine branch circuits 63*a* and 61*b* or 80*a* and 80*b* led to the lower areas.

An aqueous solution such as ethylene glycol or propylene glycol can be used as the brine for example.

Figure 9:
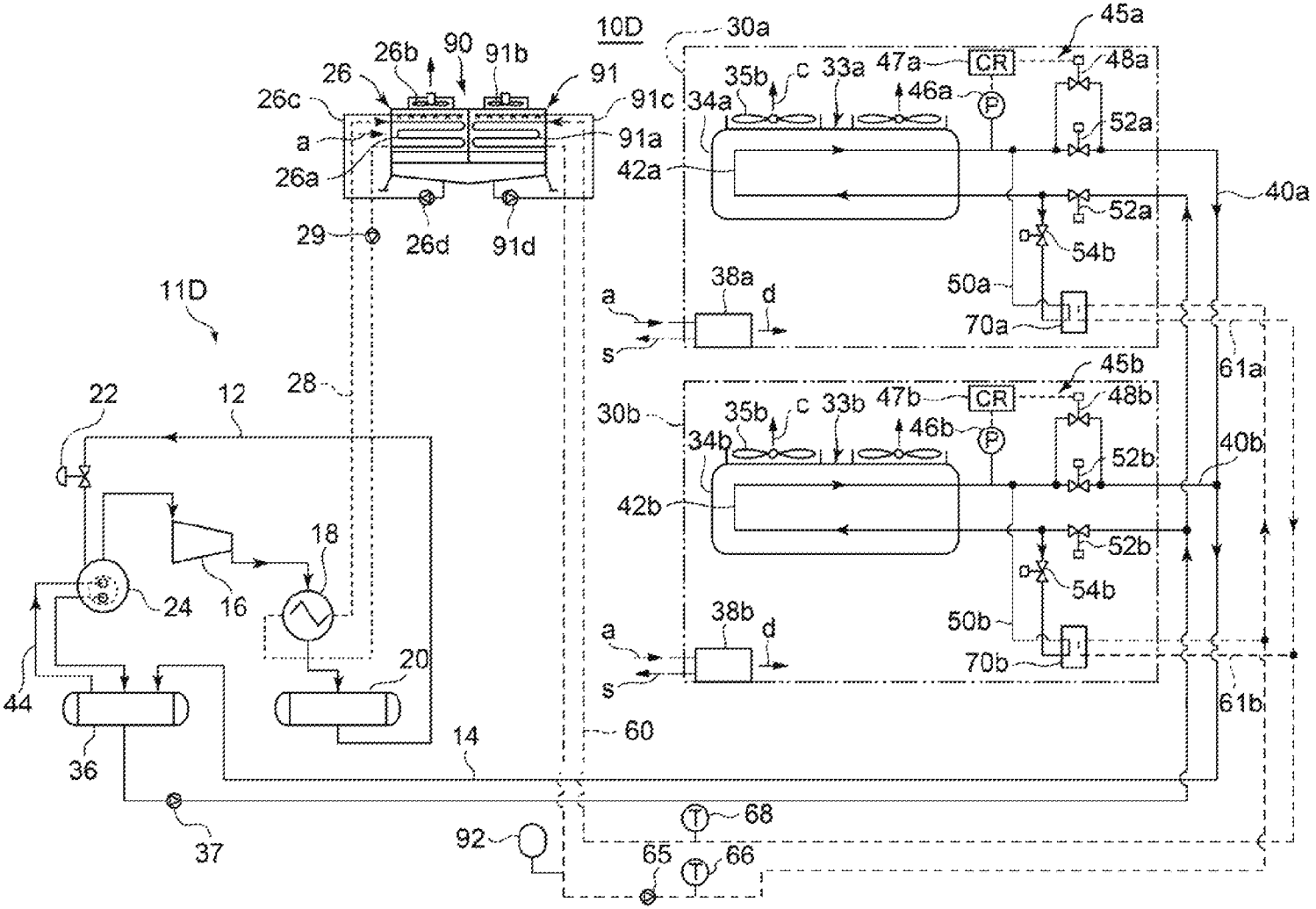
FIG. 9 is a system diagram of a refrigeration apparatus according to one embodiment.

In the embodiments shown in FIG. 1 and FIG. 9, the circulation path forming path is provided with the defrost circuits 50*a* and 50*b* as well as the heat exchanger parts 70*a* and 70*b* as the first heat exchanger part.

In the embodiments shown in FIG. 2 to FIG. 6, bypass tubes 72*a* and 72*b* are disposed as the circulation path forming path, and the heat exchanger part including the lower areas of the heat exchanger pipes 42*a* and 42*b* and the brine branch circuits 61*a* and 61*b* led to the lower areas is formed as the heat exchanger part.

In the embodiments shown in FIG. 1 to FIG. 9, the $CO_2$ circulation path is provided with a difference in elevation in the upper and lower direction, and the first heat exchanger part is formed in the lower area of the $CO_2$ circulation path More specifically, in the embodiments shown in FIG. 1 and FIG. 9, the $CO_2$ circulation path is provided with the difference in elevation because the defrost circuits 50*a* and 50*b* are disposed below the cooling devices 33*a* and 33*b*. In the embodiments shown in FIG. 2 to FIG. 6, the heat exchanger pipes 42*a* and 42*b* forming the $CO_2$ circulation path are provided with a difference in elevation.

In the $CO_2$ circulation path with the difference in elevation, the $CO_2$ refrigerant can be permitted to circulate in the closed circuit formed at the time of defrosting by the thermosiphon effect. More specifically, the $CO_2$ refrigerant gas vaporized by the first heat exchanger part rises due to the thermosiphon effect. The $CO_2$ refrigerant gas that has risen exchange heat with the frost that has attached to an outer surface of the heat exchanger part in the heat exchanger pipes 42*a* and 42*b* or an upper area of the heat exchanger pipe, and thus removes the frost through sublimation. The $CO_2$ refrigerant with the potential heat taken away is liquefied. The liquefied $CO_2$ refrigerant descends in the $CO_2$ circulation path with gravity. Thus, a loop thermosiphon effect is obtained, and the $CO_2$ refrigerant is permitted to naturally circulate in the closed circuit.

In some embodiments shown in FIG. 1 to FIG. 6, a second heat exchanger part (corresponding to the heat exchanger part 58) for causing heat exchange between the brine and the heating medium (cooling water) to heat the brine, and a brine circuit 60 (illustrated in dashed line) for causing the brine heated by the second heat exchanger part to circulate to the first heat exchanger part, are disposed. The brine circuit 60 is branched to the brine branch circuits 61*a* and 61*b* (illustrated in dashed line) outside the freezers 30*a* and 30*b*.

In the embodiments shown in FIG. 1 and FIG. 9, the brine branch circuits 61*a* and 61*b* are led to the heat exchanger parts 70*a* and 70*b*. In the embodiments shown in FIG. 2 to FIG. 6, the brine branch circuits 61*a* and 61*b* are connected to the brine branch circuits 63*a* and 63*b* or 80*a* and 80*b* (illustrated in dashed line) disposed in the freezers 30*a* and 30*b*, through a contact part 62.

Figure 2:
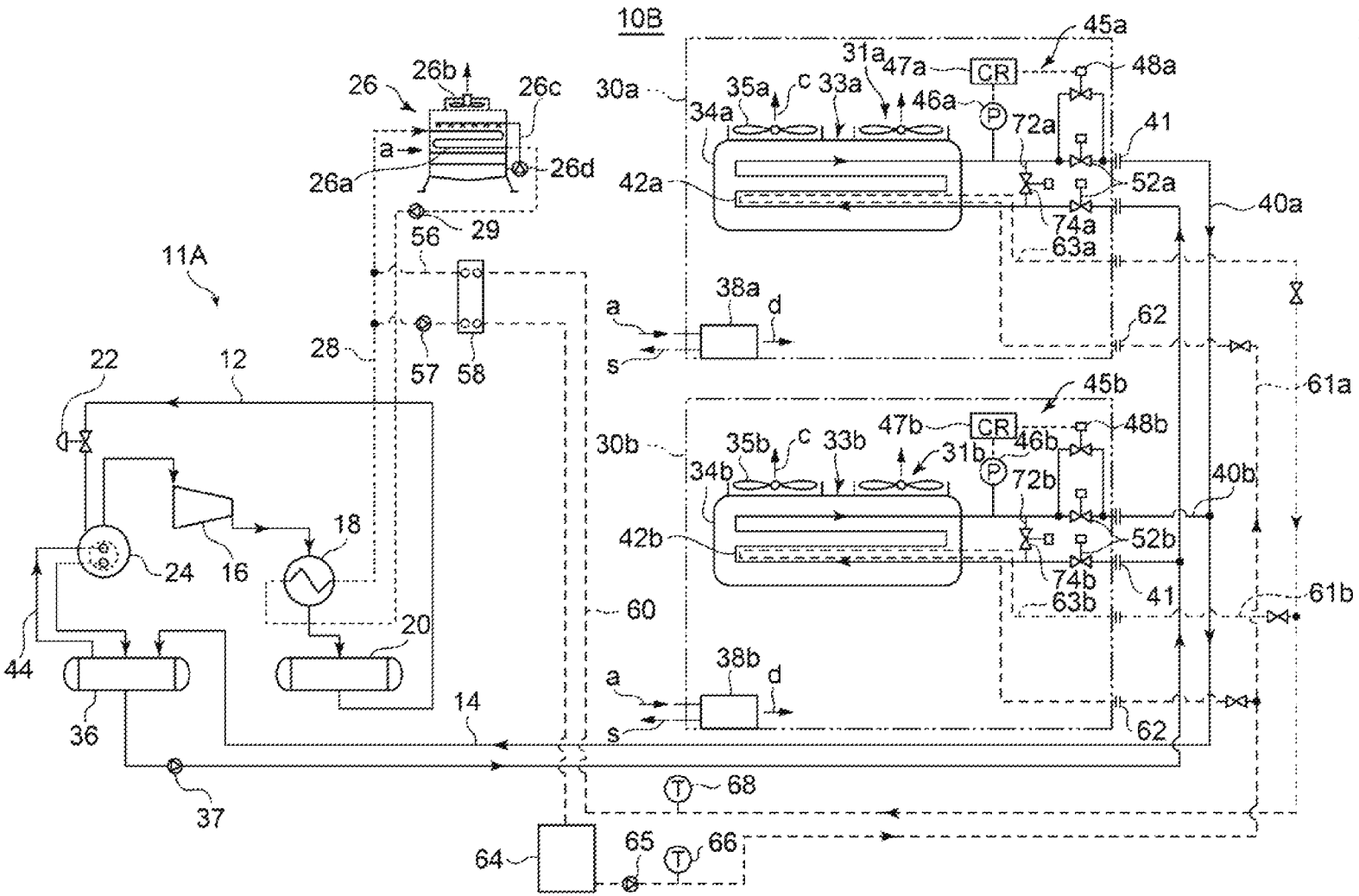
FIG. 2 is a system diagram of a refrigeration apparatus according to one embodiment.
Figure 3:
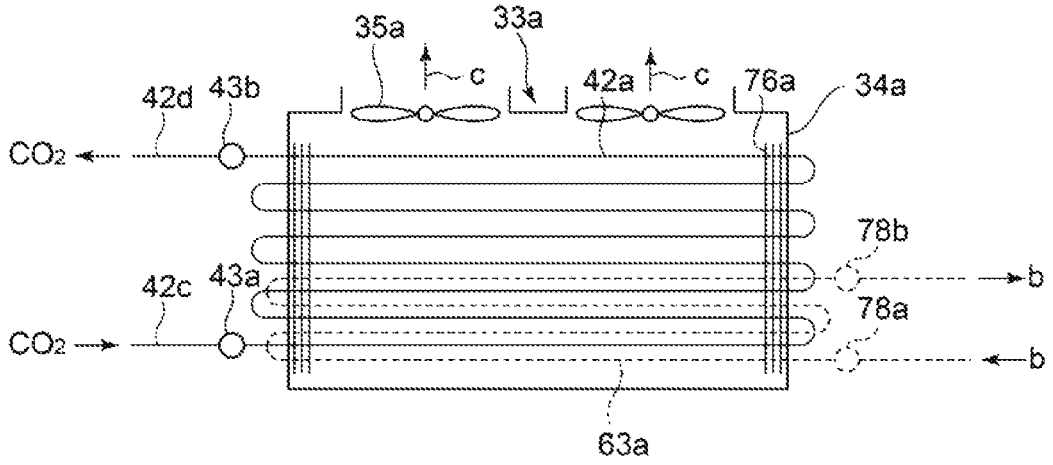
FIG. 3 is a cross-sectional view of a cooling device of the refrigeration apparatus shown in FIG. 2.

At least one embodiment shown in FIG. 2 and FIG. 3, the heat exchanger pipes 42*a* and 42*b* are disposed with the difference in elevation in the cooling devices 33*a* and 33*b*. The brine branch circuits 63*a* and 63*b* are led into the cooling devices 33*a* and 33*b* and are disposed in the lower areas of the heat exchanger pipes 42*a* and 42*b*. For example, the brine branch circuits 63*a* and 63*b* are disposed in the lower areas which are ⅓ to ⅕ of an area where the heat exchanger pipes 42*a* and 42*b* are disposed.

The first heat exchanger part is formed between the brine branch circuits 63*a* and 63*b* and the lower areas of the heat exchanger pipes 42*a* and 42*b*.

In the example configuration of the cooling device 33*a* shown in FIG. 3, the air holes are formed in the upper and side surfaces (not shown) of the casing 34*a*, and the freezer inner air c flows in through the side surface and flows out through the upper surface.

Figure 4:
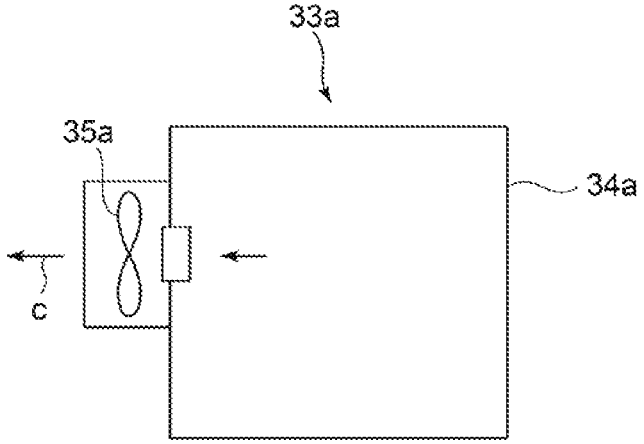
FIG. 4 is a cross-sectional view of a cooling device according to one embodiment.

In the example configuration of the cooling device 33*a* shown in FIG. 4, the air holes are formed on both side surfaces, and the freezer inner air c flows in and out of the casing 34*a* through the both side surfaces.

Figure 5:
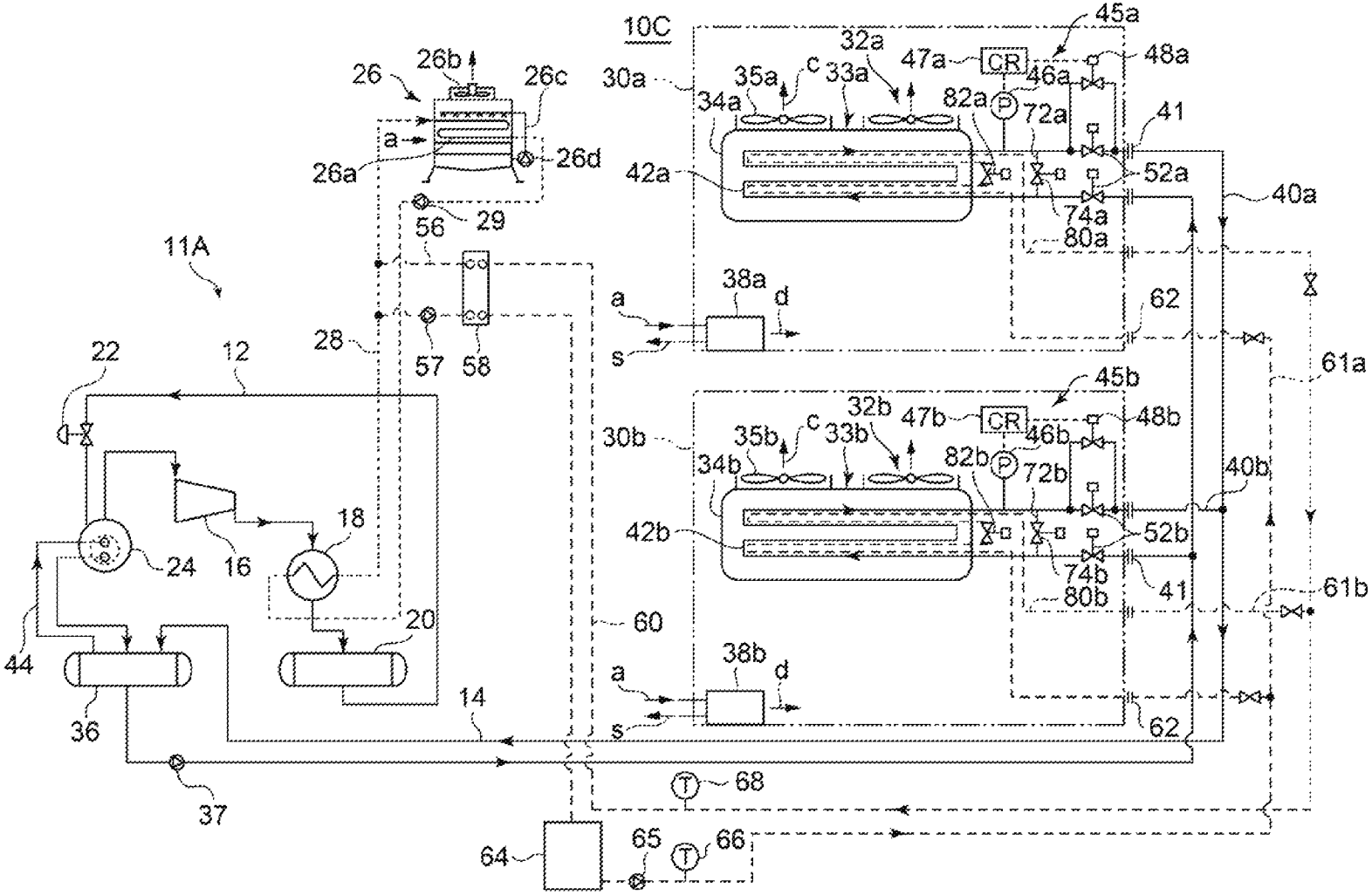
FIG. 5 is a system diagram of a refrigeration apparatus according to one embodiment.
Figure 6:
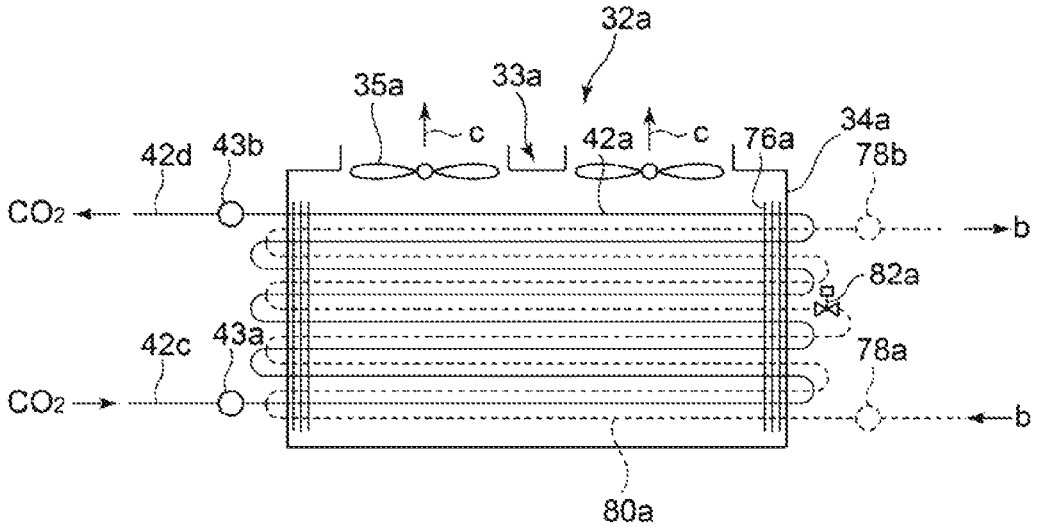
FIG. 6 is a cross-sectional view of a cooling device of the refrigeration apparatus shown in FIG. 5.

In at least one embodiment shown in FIG. 5 and FIG. 6, the heat exchanger pipes 42*a* and 42*b* and the brine branch circuits 80*a* and 80*b* are disposed in the cooling devices 33*a* and 33*b*, with the difference in elevation. The brine branch circuits 80*a* and 80*b* are configured in such a manner that the brine flows from a lower side to an upper side. Flowrate adjustment valves 82*a* and 82*b* are disposed at intermediate positions of the brine branch circuits 61*a* and 61*b* in the upper and lower direction.

In this configuration, the opening aperture of the flowrate adjustment valves 82*a* and 82*b* is narrowed, whereby the first heat exchanger part can be formed in upstream side areas of the flowrate adjustment valves 82*a* and 82*b*, that is, the heat exchanger pipes 42*a* and 42*b* on the lower side of the flowrate adjustment valves 82*a* and 82*b*.

In some embodiments shown in FIG. 1 to FIG. 9, temperature sensors 66 and 68 are respectively disposed at an inlet and an outlet of the brine circuit 60. The temperature of the brine flowing through the inlet and the outlet can be measured by the temperature sensors. It can be determined that the defrosting is almost completed when the difference between the detected valued of the temperature sensor is small. Thus, a threshold (2 to 3° C. for example) may be set for the difference between the detected values, and it may be determined that the defrosting is completed when the difference between the detected values drops to or below the threshold.

In the embodiments shown in FIG. 2 to FIG. 6, a receiver (open brine tank) 64 that temporarily stores the brine and a brine pump 65 for circulating the brine are disposed in a send path of the brine circuit 60.

In the embodiment shown in FIG. 9, an expansion tank 92 for absorbing pressure change and adjusting flowrate of the brine, is disposed instead of the receiver 64.

In some embodiments shown in FIG. 1 to FIG. 6, the refrigeration apparatuses 10A to 10C includes the refrigerating device 11A. The refrigerating device 11A includes a primary refrigerant circuit 12 in which a $NH_3$ refrigerant circulates and a refrigerating cycle component is disposed, and a secondary refrigerant circuit 14 in which the $CO_2$ refrigerant circulates. The secondary refrigerant circuit 14 extends to the cooling devices 33*a* and 33*b*. The secondary refrigerant circuit 14 is connected to the primary refrigerant circuit 12 through a cascade condenser 24.

The refrigerating cycle component disposed in the primary refrigerant circuit 12 includes a compressor 16, a condenser 18, a $NH_3$ liquid receiver 20, an expansion valve 22, and the cascade condenser 24.

The secondary refrigerant circuit 14 includes a $CO_2$ liquid receiver 36 in which a liquid $CO_2$ refrigerant liquefied by the cascade condenser 24 is temporarily stored, and a $CO_2$ liquid pump 37 that permits the liquid $CO_2$ refrigerant stored in the $CO_2$ liquid receiver 36 to circulate to the heat exchanger pipes 42*a* and 42*b*.

A $CO_2$ circulation path 44 is disposed between the cascade condenser 24 and the $CO_2$ liquid receiver 36. The $CO_2$ refrigerant gas introduced into the cascade condenser 24 through the $CO_2$ circulation path 44 from the $CO_2$ liquid receiver 36 is cooled and liquefied by the $NH_3$ refrigerant in the cascade condenser 24, and then returns to the $CO_2$ liquid receiver 36.

In the refrigerating device 11A, natural refrigerants of $NH_3$ and $CO_2$ are used, and thus an attempt to prevent the ozone layer depletion, global warming, and the like is facilitated. Furthermore, the refrigerating device 11A uses $NH_3$, with high cooling performance and toxicity, as a primary refrigerant and uses $CO_2$, with no toxicity or smell, as a secondary refrigerant, and thus can be used for room air conditioning and for refrigerating food products and the like.

Figure 7:
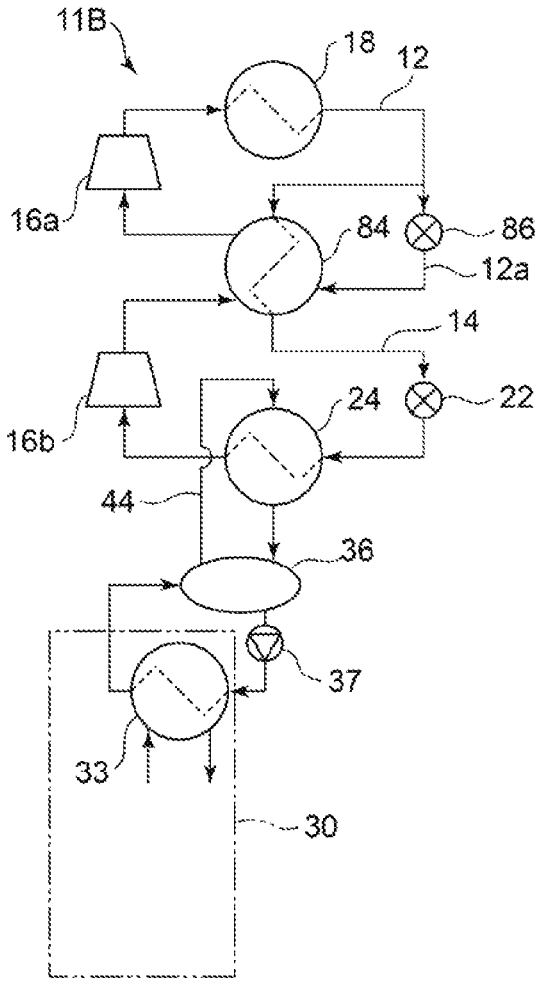
FIG. 7 is a system diagram of a refrigeration apparatus according to one embodiment.

In at least one example embodiment shown in FIG. 7, the refrigerating device 11B may be disposed instead of the refrigerating device 11A. In the refrigerating device 11B, a lower stage compressor 16*b* and a higher stage compressor 16*a* are disposed in the primary refrigerant circuit 12 in which the $NH_3$ refrigerant circulates. An intermediate cooling device 84 is disposed in the primary refrigerant circuit 12 and between the lower stage compressor 16*b* and the higher stage compressor 16*a*. A branch path 12*a* is branched from the primary refrigerant circuit 12 at an outlet of the condenser 18, and an intermediate expansion valve 86 is disposed in the branch path 12*a*.

The $NH_3$ refrigerant flowing in the branch path 12*a* is expanded and cooled in the intermediate expansion valve 86, and then is introduced into the intermediate cooling device 84. In the intermediate cooling device 84, the $NH_3$ refrigerant discharged from the lower stage compressor 16*b* is cooled with the $NH_3$ refrigerant introduced from the branch path 12*a*. Providing the intermediate cooling device 84 can improve the COP (coefficient of cooling performance) of the refrigerating device 11B.

The liquid $CO_2$ refrigerant, cooled and liquefied by exchanging heat with the $NH_3$ refrigerant in the cascade condenser 24, is stored in the liquid $CO_2$ receiver 36. Then, the liquid $CO_2$ pump 37 makes the liquid $CO_2$ refrigerant circulate in the cooling device 33 disposed in the freezer 30, from the liquid $CO_2$ receiver 36.

Figure 8:
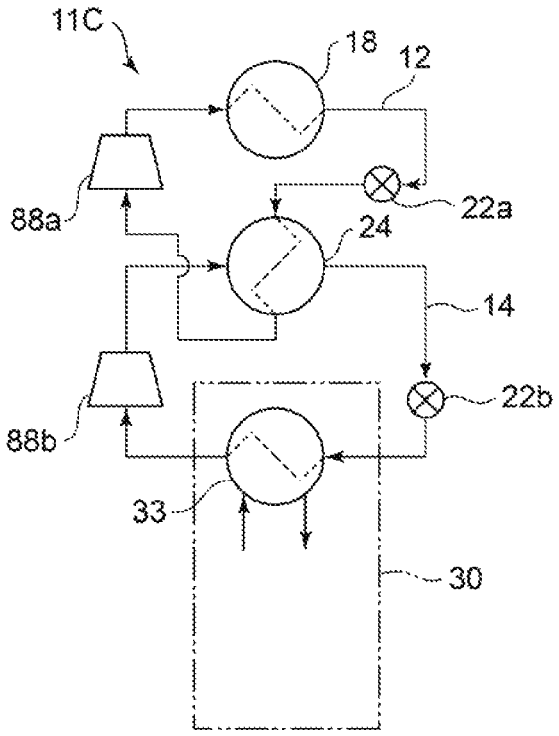
FIG. 8 is a system diagram of a refrigeration apparatus according to one embodiment.

In at least one example embodiment shown in FIG. 8, the refrigerating device 11C may be disposed instead of the refrigerating device 11A. The refrigerating device 11C forms a cascade refrigerating cycle. A higher temperature compressor 88*a* and an expansion valve 22*a* are disposed in the primary refrigerant circuit 12 in which the $NH_3$ refrigerant circulates. A lower temperature compressor 88*b* and an expansion valve 22*b* are disposed in the secondary refrigerant circuit 14 connected to the primary refrigerant circuit 12 through the cascade condenser 24.

The refrigerating device 11C is a cascade refrigerating device in which a mechanical compression refrigerating cycle is formed in each of the primary refrigerant circuit 12 and the secondary refrigerant circuit 14, whereby the COP of the refrigerating device can be improved.

In some embodiments shown in FIG. 1 to FIG. 6, the refrigeration apparatuses 10A to 10C include the refrigerating device 11A. In the refrigerating device 11A a cooling water circuit 28 is led to the condenser 18. A cooling water branch circuit 56 including the cooling water pump 57 branches from the cooling water circuit 28. The cooling water branch circuit 56 and the brine circuit 60 (illustrated in a dashed line) are led to the cooling water pump 57 as the second heat exchanger part.

Refrigerant water circulating in the cooling water circuit 28 is heated by the $NH_3$ refrigerant in the condenser 18. The heated cooling water serves as the heating medium to heat the brine circulating in the brine circuit 60 in the heat exchanger part 58, at the time of defrosting.

When the temperature of the cooling water introduced into the heat exchanger part 58 from the cooling water branch circuit 56 is 20 to 30° C. for example, the brine can be heated up to 15 to 20° C. with this cooling water.

In another embodiment, any heating medium other than the cooling water can be used as the second heating medium. Such a heating medium includes $NH_3$ refrigerant gas with high temperature and high pressure discharged from the compressor 16, warm discharge water from a factory, a medium that has absorbed heat emitted from a boiler or potential heat of an oil cooler, and the like.

As an example configuration some embodiments, the cooling water circuit 28 is disposed between the condenser 18 and a closed-type cooling tower 26. The cooling water is circulated in the cooling water circuit 28 by the cooling water pump 29. The cooling water that has absorbed exhaust heat from the $NH_3$ refrigerant in the condenser 18 comes into contact with the outer air in a closed-type cooling tower 26 and is cooled with vaporization latent heat of water.

The closed-type cooling tower 26 includes: a cooling coil 26*a* connected to the cooling water circuit 28; a fan 26*b* that blows the outer air a into the cooling coil 26*a*; and a spray pipe 26*c* and a pump 26*d* for spraying the cooling water onto the cooling coil 26*a*. The cooling water sprayed from the spray pipe 26*c* partially vaporizes. The cooling water flowing in the cooling coil 26*c* is cooled with the vaporization latent heat thus produced.

In at least one embodiment shown in FIG. 9, the refrigerating device 11D disposed in the refrigeration apparatus 10D includes a closed-type cooling and heating unit 90 in which the closed-type cooling tower 26 and a closed-type heating tower 91 are integrally formed. The closed-type cooling tower 26 in the present embodiment cools the cooling water circulating in the cooling water circuit 28 through heat exchange with spray water, and has the basic configuration that is the same as that of the closed-type cooling tower 26 shown in FIG. 1 to FIG. 6.

The closed-type heating tower 91 receives spray water used for cooling the cooling water circulating in the cooling water circuit 28 in the closed-type cooling tower 26, and causes heat exchange between the spray water and the brine circulating in the brine circuit 60. The closed-type heating tower 91 includes: a heating coil 91*a* connected to the brine circuit 60; and a spray pipe 91*c* and a pump 91*d* for spraying the cooling water onto the cooling coil 91*a*. An inside of the closed-type cooling tower 26 communicates with an inside of the closed-type heating tower 91 through a lower portion of a common housing.

The spray water that has absorbed the exhaust heat from the $NH_3$ refrigerant circulating in the primary refrigerant circuit 12 is sprayed onto the cooling coil 91*a* from the spray pipe 91*c*, and serves as a heating medium which heats the brine circulating in the cooling coil 91*a* and the brine circuit 60.

In some embodiments shown in FIG. 1 to FIG. 9, the secondary refrigerant circuit 14 is branched to $CO_2$ branch circuits 40*a* and 40*b* outside the freezers 30*a* and 30*b*. The $CO_2$ branch circuits 40*a* and 40*b* are connected to the inlet tube and the outlet tube of the heat exchanger pipes 42*a* and 42*b* outside the freezers 30*a* and 30*b*.

The brine circuit 60 extending to a portion near the freezers 30*a* and 30*b* from the heat exchanger part 58 is branched to brine branch circuits 61*a* and 61*b* (illustrated in dashed line) outside the freezers 30*a* and 30*b*.

In the refrigeration apparatus 10A shown in FIG. 1, the brine branch circuits 61*a* and 61*b* are led to the heat exchanger parts 70*a* and 70*b* disposed in the freezers 30*a* and 30*b*.

The sublimation defrosting is performed in the refrigeration apparatus 10A as follows. Specifically, when the freezer inner air in the freezers 30*a* and 30*b* has saturated water vapor pressure, the dehumidifier devices 38*a* and 38*b* are operated for dehumidification to achieve low water vapor partial pressure. Then, the solenoid on-off valves 52*a* and 52*b* are closed so that the $CO_2$ circulation path, including the heat exchanger pipe 42*a* and 42*b* and the defrost circuits 50*a* and 50*b*, becomes the closed circuit.

The detected values of the pressure sensors 46*a* and 46*b* are input to the control devices 47*a* and 47*b*. The control devices 47*a* and 47*b* operates the pressure regulating valves 48*a* and 48*b* based on the detected values to adjust the pressure of the $CO_2$ refrigerant circulating in the closed circuit so that the condensing temperature of the $CO_2$ refrigerant becomes equal to or lower than the freezing point (for example, 0° C.) of the water vapor in the freezer inner air. For example, the $CO_2$ refrigerant is boosted to 3.0 MPa (condensing temperature −5° C.).

Then, the $CO_2$ refrigerant is vaporized through the heat exchange between the brine and the $CO_2$ refrigerant in the heat exchanger parts 70*a* and 70*b*. Then, the vaporized $CO_2$ refrigerant is circulated in the closed circuit, whereby the frost attached to the outer surface of the heat exchanger pipes 42*a* and 42*b* is removed through sublimation with the condensing latent heat (249 kJ/kg at −5° C./3.0 MPa) of the $CO_2$ refrigerant.

The lower limit value of the condensing temperature of the $CO_2$ refrigerant to be adjusted for the sublimation of the frost is a freezer inner temperature (for example, −25° C.). During the refrigerating operation, the $CO_2$ refrigerant at a temperature equal to or lower than the freezer inner temperature (for example, −30° C.) is permitted to circulate in the heat exchanger pipes 42*a* and 42*b* for cooling in the freezer. Thus, the temperature of the frost is equal to or lower than the freezer inner temperature (for example, −25° C. to −30° C.), accordingly, sublimation of frost through heating can be achieved when the condensing temperature of the CO2 refrigerant is within a range of the freezer inner temperature and the freezing point of the water vapor in the freezer at the time of sublimation defrosting.

In the present embodiment, the defrost circuits 50*a* and 50*b* are disposed below the heat exchanger pipes 42*a* and 42*b*, and the $CO_2$ circulation path has the difference in elevation. Thus, the $CO_2$ refrigerant vaporized in the heat exchanger parts 70*a* and 70*b* rises to the heat exchanger pipes 42*a* and 42*b* due to the thermosiphon effect. Thus, the frost attached to the outer surfaces of the heat exchanger pipes 42*a* and 42*b* is sublimated and thus is liquefied by the potential heat of the $CO_2$ refrigerant gas that has risen to the heat exchanger pipes 42*a* and 42*b*. The liquefied $CO_2$ refrigerant descends in the defrost circuits 50*a* and 50*b* with gravity, and then is vaporized again in the heat exchanger part 70*a* and 70*b*.

In the refrigeration apparatus 10B shown in FIG. 2 and FIG. 3 and in the refrigeration apparatus 10C shown in FIG. 5 and FIG. 6, the heat exchanger pipes 42*a* and 42*b* as well as the brine branch circuits 63*a* and 63*b* or 80*a* and 80*b* are disposed in the cooling devices 33*a* and 33*b* with the difference in elevation.

Bypass tubes 72*a* and 72*b* are connected between the inlet tube and the outlet tube of the heat exchanger pipes 42*a* and 42*b* outside the casings 34*a* and 34*b*. Solenoid on-off valves 74*a* and 74*b* are disposed in the bypass tubes 72*a* and 72*b*.

In the inlet tube, the solenoid on-off valves 54*a* and 54*b* are disposed on the upstream side of the bypass tubes 52*a* and 52*b*. In the outlet tube, the solenoid on-off valves 54*a* and 54*b* are disposed on the downstream side of the bypass tubes 52*a* and 52*b*.

In the refrigeration apparatus 10B, the brine branch circuits 63*a* and 63*b* are led to the lower areas of the heat exchanger pipes 42*a* and 42*b*. The heat exchanger part is formed of the lower areas of the heat exchanger pipes 42*a* and 42*b* and the brine branch circuits 63*a* and 63*b*.

In the refrigeration apparatus 10C, the brine branch circuits 80*a* and 80*b* are disposed over substantially the entire area of the area where the heat exchanger pipes 42*a* and 42*b* are disposed. The flowrate adjustment valves 82*a* and 82*b* are disposed at intermediate portions of the brine branch circuits 80*a* and 80*b* in the upper and lower direction. The brine branch circuits 80*a* and 80*b* form a flow path in which brine b flows to an upper area from a lower area.

In an example configuration of the cooling devices 33*a* and 33*b*, for example, as in the cooling device 33*a* shown in FIG. 3 or FIG. 6, the heat exchanger pipes 42*a* and 42*b* as well as the brine branch circuit 63*a* and 63*b* or 80*a* and 80*b* have the winding shape and are arranged in the horizontal direction and in the upper and lower direction. The brine branch circuits 80*a* and 80*b* form the flow path in which brine b flows to an upper area from a lower area.

The heat exchanger pipe 42*a* includes headers 43*a* and 43*b* in the inlet tube 42*c* and the outlet tube 42*d*, outside the cooling device 33*a*. The brine branch circuits 63*a* and 80*a* includes headers 78*a* and 78*b* at an inlet and an outlet of the cooling device 33*a*.

A large number of plate fins 76*a* are disposed in the upper and lower direction in the cooling device 33*a*. The heat exchanger pipe 42*a* and the branch circuit 63*a* or 80*a* are inserted in a large number of holes formed on the plate fins 76*a* and thus are supported by the plate fins 76*a*. With the plate fins 76*a*, supporting strength for the pipes is increased, and the heat transmission between the heat exchanger pipe 42*a* and the brine branch circuit 63*a* or 80*a* is facilitated.

During the refrigerating operation, the fan 35*a* diffuses the freezer inner air c cooled in the cooling device 33*a* into the freezer 32*a*. Because no dissolved water is produced at the time of defrosting, a drain pan is not disposed below the casing 34*a*. The configuration of the cooling device 33*a* described above is the same as that of the cooling device 33*b*.

In the refrigerating devices 11B and 11C, the inlet tube 42*c* and the outlet tube 42*d* of the heat exchanger pipes 42*a* and 42*b* are connected to the $CO_2$ branch circuits 40*a* and 40*b* through the contact part 41, outside the freezers 30*a* and 30*b*. The brine branch circuits 63*a*, 63*b*, 80*a*, and 80*b* are connected to the brine branch circuits 61*a* and 61*b* through the contact part 62, outside the freezers 30*a* and 30*b*.

In the refrigeration apparatus 10B, the casings 34*a* and 34*b* of the freezers 30*a* and 30*b*, the heat exchanger pipes 42*a* and 42*b* including the inlet tube 42*c* and the outlet tube 42*d*, the brine branch circuits 63*a* and 63*b*, and the bypass tubes 72*a* and 72*b* form the cooling units 31*a* and 31*b* that are integrally formed.

In the refrigeration apparatus 10C, the casings 34*a* and 34*b* of the freezers 30*a* and 30*b*, the heat exchanger pipes 42*a* and 42*b* including the inlet tube 42*c* and the outlet tube 42*d*, the brine branch circuits 80*a* and 80*b*, and the bypass tubes 72*a* and 72*b* form the cooling units 32*a* and 32*b* that are integrally formed.

The cooling units 31*a* and 31*b* or 32*a* and 32*b* are detachably connected to the $CO_2$ branch circuits 40*a* and 40*b* and the brine branch circuits 61*a* and 61*b* through the contact parts 41 and 62.

In the refrigeration apparatuses 10B and 10C, the solenoid on-off valves 74*a* and 74*b* are closed, and the solenoid on-off valves 52*a* and 52*b* are opened during the refrigerating operation. The solenoid on-off valves 74*a* and 74*b* are opened, and the solenoid on-off valves 52*a* and 52*b* are closed at the time of defrosting, whereby the closed circuit including the heat exchanger pipes 42*a* and 42*b* and the bypass tubes 72*a* and 72*b* is formed.

In the refrigeration apparatus 10B, the $CO_2$ refrigerant is vaporized by the potential heat of the brine flowing in the brine branch circuits 63*a* and 63*b*, in the lower areas of the heat exchanger pipes 42*a* and 42*b*, at the time of defrosting. The vaporized $CO_2$ refrigerant rises to the upper areas of the heat exchanger pipes 42*a* and 42*b*, and removes the frost attached to the outer surfaces of the heat exchanger pipes 42*a* and 42*b* in the upper areas, through sublimation. The $CO_2$ refrigerant that has humidified the frost through sublimation is liquefied and descends by gravity, and vaporizes again in the lower area. Thus, the $CO_2$ refrigerant is naturally circulated in the closed circuit by the thermosiphon effect.

In the refrigeration apparatus 10C, at the time of defrosting, the opening apertures of the flowrate adjustment valves 82*a* and 82*b* are narrowed so that the flowrate of the brine b is restricted. Thus, the heat exchanger part in which the $CO_2$ refrigerant and the brine exchange heat can be formed only in the upstream area (lower area) of the flowrate adjustment valves 82*a* and 82*b*.

Thus, the $CO_2$ refrigerant is naturally circulated by the thermosiphon effect and the frost can be removed through sublimation by the potential heat of the circulating $CO_2$ refrigerant, between the areas of the heat exchanger pipes 42*a* and 42*b* corresponding to the upstream and the downstream areas of the flowrate adjustment valves 82*a* and 82*b*.

According to some embodiments shown in FIG. 1 to FIG. 10, the frost attached to the outer surfaces of the heat exchanger pipes 42*a* and 42*b* is heated by the heat of the $CO_2$ refrigerant flowing in the heat exchanger pipe, whereby uniform heating can be achieved in the enter area of the heat exchanger pipe. The condensing temperature of the $CO_2$ refrigerant is controlled by adjusting the pressure in the closed circuit. Thus, the temperature of the $CO_2$ refrigerant gas flowing in the closed circuit can be accurately controlled, so that the frost can be heated to a temperature at or above the freezing point accurately, whereby the sublimation defrosting can be achieved.

The fans 35*a* and 35*b* are operated at the time of defrosting, so that the air flow flowing in and out of the casings 34*a* and 34*b* is formed, whereby the sublimation can be facilitated.

Thus, the frost attached to the heat exchanger pipes 42*a* and 42*b* is not melted but is sublimated, and thus a drain pan and a facility for discharging the drainage accumulated in the drain pan are not required, whereby the cost of the refrigeration apparatus can be largely reduced. The frost attached to the heat exchanger pipes 42*a* and 42*b* is heated from the inside through a pipe wall of the heat exchanger pipe only. Thus, the heat exchange efficiency can be improved and power saving can be achieved.

The defrosting can be achieved with the $CO_2$ refrigerant in a low pressure state. Thus, a pipe system device such as the $CO_2$ circulation path needs not to be pressure resistant, whereby a high cost is not required.

Thus, with the sublimation defrosting achieved, a micro channel heat exchanger pipe, which is considered to be difficult to apply to the cooling device for a freezer due to the large performance degradation caused by frost formation and dew condensation, can be employed. This technique can be applied not only to the freezer, but can also be applied to a defrost method for a batch freezing chamber or a freezer requiring continuous non-defrosting operation for a long period of time.

In the refrigeration apparatus 10A shown in FIG. 1, the defrost circuits 50*a* and 50*b* are disposed to form the $CO_2$ circulation path, whereby the first heat exchanger part formed in the $CO_2$ circulation path can be more freely disposed.

In the refrigeration apparatus 10B shown in FIG. 2 and FIG. 3, the $CO_2$ circulation path is formed of the heat exchanger pipes 42*a* and 42*b* only, except for the bypass tubes 72*a* and 72*b*, and thus there is no need to additionally provide new pipes, whereby a high cost is not required.

In some embodiments shown in FIG. 1 to FIG. 9, the $CO_2$ refrigerant can be permitted to naturally circulate in the closed circuit by the thermosiphon effect. Thus, a unit for forcibly circulating the $CO_2$ refrigerant in the closed circuit is not required, and equipment and power (pump power) for the forcing circulation are not required, whereby cost reduction can be achieved.

The brine circuit 60 is provided, and can be disposed in accordance with a disposed position of the heat exchanger part in which the heated brine exchanges heat with the $CO_2$ refrigerant. Thus, a position where the heat exchanger part is disposed can be more freely determined.

In the embodiments shown in FIG. 2 and FIG. 3, the heat exchanger part involving the brine is formed by the lower areas of the heat exchanger pipes 42*a* and 42*b*, and the $CO_2$ refrigerant is permitted to naturally circulate by the thermosiphon effect. Thus, no additional pipes other than the bypass tubes 72*a* and 72*b* are required, and no equipment for forcing circulation is required. All things considered, the cost of the cooling devices 33*a* and 33*b* can be reduced.

The brine branch circuits 63*a* and 63*b* are not disposed in the upper areas of the heat exchanger pipes 42*a* and 42*b*, whereby the power used for the fans 35*a* and 35*b* for forming airflow in the cooling devices 33*a* and 33*b* can be reduced. The cooling performance of the cooling devices 33*a* and 33*b* can be improved by additionally providing the heat exchanger pipes 42*a* and 42*b* in a vacant space in the upper area.

In the embodiment shown in FIG. 5 and FIG. 6, the brine branch circuits 80*a* and 80*b* are disposed over the entire heat exchanger pipes 42*a* and 42*b* in the upper and lower direction, and the brine flowrate is regulated by the flowrate adjustment valves 82*a* and 82*b*. Thus, the heat exchanger part can be formed only in the lower areas of the heat exchanger pipes 42*a* and 42*b*. Thus, the sublimation defrosting can be achieved with a simple arrangement of adding the flowrate adjustment valves 82*a* and 82*b* to the known cooling device.

In some embodiments shown in FIG. 1 to FIG. 9, the timing at which the defrosting is completed can be accurately obtained based on the detected values of the temperature sensors 66 and 68 respectively disposed at the inlet and the outlet of the brine circuit 60. Thus, excessive heating in the freezer or diffusion of the water vapor due to the excessive heating can be prevented, and further power saving can be achieved. Furthermore, a stable temperature in the freezer can be achieved, whereby the quality of food products frozen in the freezer can be improved.

In some embodiments shown in FIG. 1 to FIG. 9, the pressure adjusting units 45*a* and 45*b* are disposed as a pressure adjusting unit for the $CO_2$ refrigerant circulating in the closed circuit. Thus, the pressure can be accurately adjusted easily at a low cost.

In some embodiments shown in FIG. 1 to FIG. 5, the cooling water circuit 28 is led to the heat exchanger part 58, and the cooling water heated in the condenser 18 is used as the heating medium for heating the brine. Thus, no heating source outside the refrigeration apparatus is required. The temperature of the cooling water can be lowered with the brine at the time of defrosting, whereby the condensing temperature of the $NH_3$ refrigerant during the refrigerating operation can be lowered, and the COP of the refrigerating device can be improved.

The heat exchanger part 58 can be disposed in the closed-type cooling tower 26. Whereby a space where an apparatus used for defrosting is installed can be downsized.

In the embodiments shown in FIG. 9, the heat exchange between the heating medium and the brine takes place in the closed-type heating tower 91 integrally formed with the closed-type cooling tower 26. Thus, a space where the second heat exchanger part is installed can be downsized. By using the spray water in the closed-type cooling tower 26 as the heat source for the brine, the heat can also be acquired from the outer air. When the refrigeration apparatus 10D employs an air cooling system, the cooling water can be cooled and the brine can be heated with the outer air as the heat source, with the heating tower alone.

Furthermore, by using the cooling units 31*a*, 31*b*, 32*a*, and 32*b* of the configuration described above, the cooling devices 33*a* and 33*b* with a defrosting device can be easily attached to the freezers 30*a* and 30*b*. When the units are integrally assembled in advance, the attachment to the freezers 30*a* and 30*b* is further facilitated.

Figure 10:
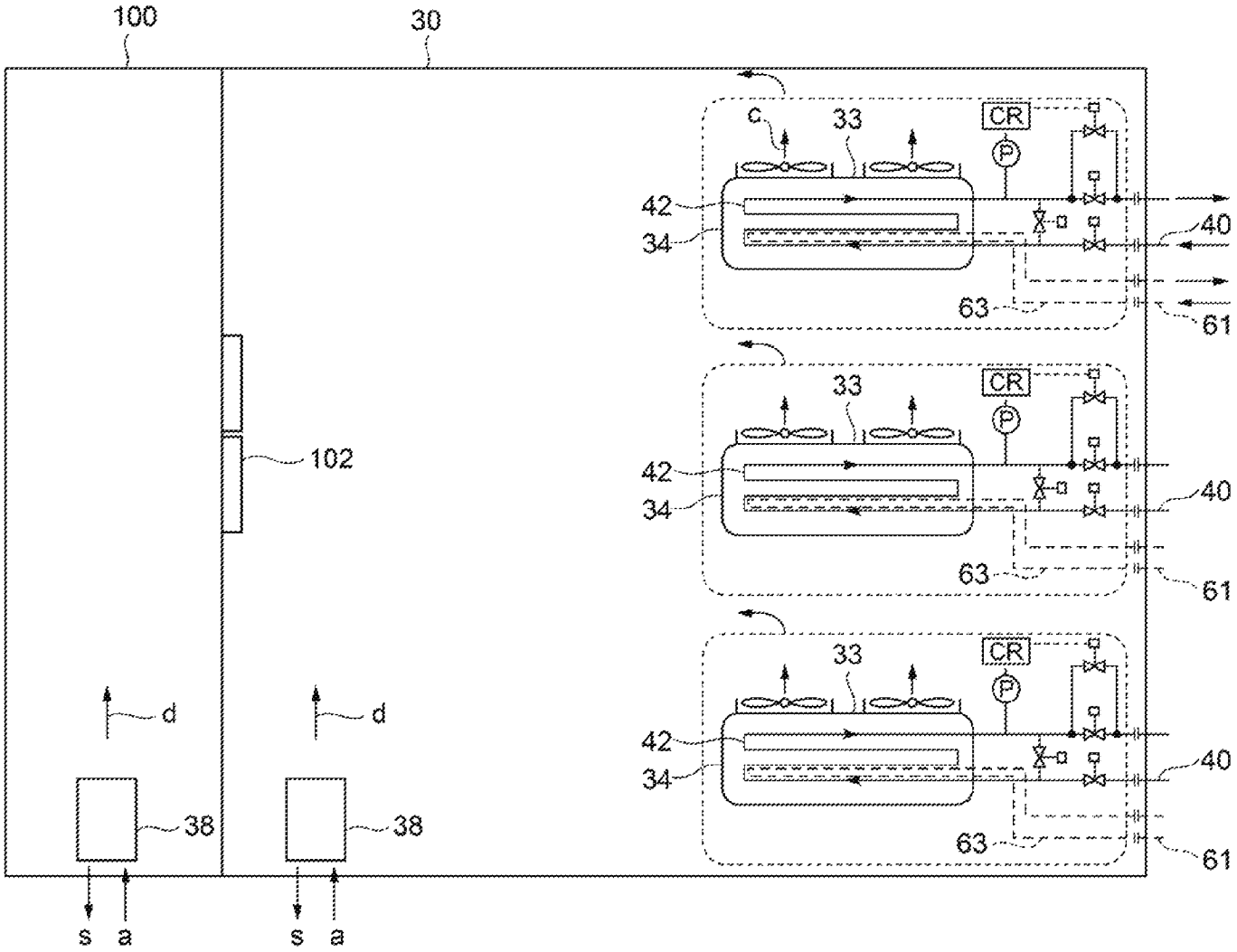
FIG. 10 is an arrangement diagram of a refrigeration apparatus according to one embodiment.

FIG. 10 shows a still another embodiment. A cargo-handling chamber 100 is disposed adjacent to the freezer 30 of this embodiment. The freezer 30 includes a plurality of the cooling devices 33 having the configuration described above. For example, the cooling device 33 includes the casing 34, the heat exchanger pipe 42, the brine branch circuits 61 and 63, the $CO_2$ branch circuit 40, and the like having the configuration described above.

The freezer 30 and the cargo-handling chamber 100 each incorporate the dehumidifier device 38 such as the desiccant humidifier. The dehumidifier device 38 takes in the outer air a from the outside of the chamber and discharges the water vapor s from the chamber, whereby the cold dry air d is supplied into the chamber.

The temperature in the cargo-handling chamber 100 is kept at +5° C. for example. An electric heat insulating door 102 is disposed at an entrance for going in and out of the freezer 30 from the cargo-handling chamber 100. Thus, the amount of water vapor entering the freezer 30 when the door is opened/closed is minimized.

For example, when the freezer 30 is cooled to have a temperature of −25° C., and has a volume of 7, 500 $m^3$ the absolute humidity is 0.4 g/kg at the relative humidity of 100% and the absolute humidity is 0.1 g/kg at the relative humidity of 25%. Thus, the amount of containable water vapor, obtained by multiplying the difference in the absolute humidity by the volume of the freezer 30, is 2.25 kg. Thus, the sublimation defrosting can be well achieved by setting the relative humidity of the freezer inner air to 25%.

INDUSTRIAL APPLICABILITY

According to the present invention the sublimation defrosting can be achieved, whereby the initial and running costs require for the defrosting in the refrigeration apparatus can be reduced, and the power saving can be achieved

REFERENCE SIGNS LIST

10A, 10B, 10C, 10D refrigeration apparatus
11A, 11B, 11C, 11D refrigerating device
12 primary refrigerant circuit
14 secondary refrigerant circuit
16 compressor
16*a* higher stage compressor
16*b* lower stage compressor
18 condenser
20 $NH_3$ liquid receiver
22, 22*a*, 22*b* expansion valve
24 cascade condenser
26 closed-type cooling tower
28 cooling water circuit
29, 57 cooling water pump
30, 30*a*, 30*b* freezer
31*a*, 31*b*, 32*a*, 32*b* cooling unit
33, 33*a*, 33*b* cooling device
34, 34*a*, 34*b* casing
35*a*, 35*b* fan
36 $CO_2$ liquid receiver
37 $CO_2$ liquid pump
38, 38*a*, 38*b* dehumidifier device
40, 40*a*, 40*b* $CO_2$ branch circuit
41, 62 contact part
42, 42*a*, 42*b* heat exchanger pipe
42*c* inlet tube
42*d* outlet tube
43*a*, 43*b*, 78*a*, 78*b* header
44 $CO_2$ circulation path
45*a*, 45*b* pressure adjusting unit
46*a*, 46*b* pressure sensor
47*a*, 47*b* control device
48*a*, 48*b* pressure regulating valve
50*a*, 50*b* defrost circuit
52*a*, 52*b*, 74*a*, 74*b* solenoid on-off valve
56 cooling water branch circuit
58 heat exchanger part (second heat exchanger part)
60 brine circuit
61, 61*a*, 61*b*, 63, 63*a*, 63*b*, 80*a*, 80*b* brine branch circuit
64 receiver
65 brine pump
66 temperature sensor (first temperature sensor)
68 temperature sensor (second temperature sensor)
70 heat exchanger part (first heat exchanger part)
72*a*, 72*b* bypass tube
76*a* plate fin
82*a*, 82*b* flowrate adjustment valve
84 intermediate cooling device
86 intermediate expansion valve
88*a* higher temperature compressor
88*b* lower temperature compressor
90 closed-type cooling and heating unit
91 closed-type heating tower
92 expansion tank
100 cargo-handling chamber
102 heat insulating door
a outer air
b brine
c freezer inner air
d cold dry air

The invention claimed is:

1. A sublimation defrost system for a refrigeration apparatus including: a cooling device which is disposed in a freezer, and includes a casing and a heat exchanger pipe disposed in the casing; a refrigerating device for cooling and liquefying a $CO_2$ refrigerant; and a refrigerant circuit which is connected to the heat exchanger pipe and which is configured to permits the $CO_2$ refrigerant cooled and liquefied in the refrigerating device to circulate to the heat exchanger pipe, the defrost system comprising:

a dehumidifier device for dehumidifying freezer inner air in the freezer;

a $CO_2$ circulation path which is formed of a circulation path forming path connected to an inlet path and an outlet path of the heat exchanger pipe, and includes the heat exchanger pipe;

an on-off valve disposed in each of the inlet path and the outlet path of the heat exchanger pipe and configured to be closed at a time of defrosting so that the $CO_2$ circulation path becomes a closed circuit;

a circulating unit for $CO_2$ refrigerant, the circulating unit being disposed in the $CO_2$ circulation path;

a first heat exchanger part configured to cause heat exchange between a brine as a first heating medium and the $CO_2$ refrigerant circulating in the $CO_2$ circulation path; and a pressure adjusting unit which adjusts a pressure of the $CO_2$ refrigerant circulating in the closed circuit at the time of defrosting so that a condensing temperature of the $CO_2$ refrigerant becomes equal to or lower than a freezing point of a water vapor in the freezer inner air in the freezer; wherein the defrosting is able to be achieved without a drain receiving unit.

2. The sublimation defrost system for the refrigeration apparatus according to claim 1, wherein the circulation path forming path is a defrost circuit branched from the inlet path and the outlet path of the heat exchanger pipe, and the first heat exchanger part is formed in the defrost circuit.

3. The sublimation defrost system for the refrigeration apparatus according to claim 1, wherein the circulation path forming path is a bypass path disposed between the inlet path and the outlet path of the heat exchanger pipe, and the first heat exchanger part is formed in a partial area of the heat exchanger pipe.

4. The sublimation defrost system for the refrigeration apparatus according to claim 1, wherein the $CO_2$ circulation path is formed with a difference in elevation, and the first heat exchanger part is formed in a lower area of the $CO_2$ circulation path, and the circulating unit is configured to permits the $CO_2$ refrigerant to naturally circulate in the closed circuit at the time of defrosting by a thermosiphon effect.

5. The sublimation defrost system for the refrigeration apparatus according to claim 1, further comprising:

a second heat exchanger part for heating the brine with a second heating medium; and a brine circuit for permitting the brine heated by the second heating unit to be circulated to the first heating unit, the brine circuit being connected to the first heating unit and the second heating unit.

6. The sublimation defrost system for the refrigeration apparatus according to claim 5, wherein the heat exchanger pipe is provided with a difference in elevation in the cooling device, the brine circuit is formed in the cooling device and in a lower area of the heat exchanger pipe, and the first heat exchanger part is formed between the brine circuit and the lower area of the heat exchanger pipe.

7. The sublimation defrost system for the refrigeration apparatus according to claim 6, wherein each of the heat exchanging pipe and the brine circuit is provided with a difference in elevation in the cooling device and is configured in such a manner that the brine flows from a lower side to an upper side in the brine circuit, and a flowrate adjustment valve is disposed at an intermediate position in the brine circuit in an upper and lower direction, and the first heat exchanger part is formed at a portion of the brine circuit on an upstream side of the flowrate adjustment valve.

8. The sublimation defrost system for the refrigeration apparatus according to claim 5, further comprising a first temperature sensor and a second temperature sensor which are respectively disposed at an inlet and an outlet of the brine circuit to detect a temperature of the brine flowing through the inlet and the outlet.

9. The sublimation defrost system for the refrigeration apparatus according to claim 1, wherein the pressure adjusting unit includes:

a pressure sensor for detecting the pressure of the $CO_2$ refrigerant circulating in the closed circuit;

a pressure adjusting valve disposed in the outlet path of the heat exchanger pipe; and a control device for receiving a detected value from the pressure sensor, and controlling an opening aperture of the pressure adjusting valve in such a manner that the condensing temperature of the $CO_2$ refrigerant circulating in the closed circuit becomes equal to or lower than the freezing point of the water vapor in the freezer inner air in the freezer.

10. The sublimation defrost system for the refrigeration apparatus according to claim 1, wherein the refrigerating device includes:

a primary refrigerant circuit in which $NH_3$ refrigerant circulates and a refrigerating cycle component is disposed;

a secondary refrigerant circuit in which the $CO_2$ refrigerant circulates, the secondary refrigerant circuit led to the cooling device, the secondary refrigerant circuit being connected to the primary refrigerant circuit through a cascade condenser; and a liquid $CO_2$ receiver for storing the $CO_2$ refrigerant liquefied in the cascade condenser and a liquid $CO_2$ pump for sending the $CO_2$ refrigerant stored in the liquid $CO_2$ receiver to the cooling device, which are disposed in the secondary refrigerant circuit.

11. The sublimation defrost system for the refrigeration apparatus according to claim 10, further comprising:

a second heat exchanger part for heating the brine with a second heating medium;

a brine circuit for permitting the brine heated by the second heating unit to be circulated to the first heating unit, the brine circuit being connected to the first heating unit and the second heating unit; and a cooling water circuit led to a condenser provided as a part of the refrigerating cycle component disposed in the primary refrigerant circuit, wherein the second heat exchanger part is a heat exchanger to which the cooling water circuit and the brine circuit are led, the heat exchanger configured to heat the brine circulating in the brine circuit with cooling water heated by the condenser.

12. The sublimation defrost system for the refrigeration apparatus according to claim 10, further comprising:

a second heat exchanger part for heating the brine with a second heating medium;

a brine circuit for permitting the brine heated by the second heating unit to be circulated to the first heating unit, the brine circuit being connected to the first heating unit and the second heating unit;

a cooling water circuit led to a condenser provided as a part of the refrigerating cycle component disposed in the primary refrigerant circuit; and a cooling tower for cooling the cooling water circulating in the cooling water circuit by exchanging heat between the cooling water and spray water, wherein the second heat exchanger part includes a heating tower for receiving the spray water and exchanging heat between the brine circulating in the brine circuit and the spray water, the heating tower being integrally formed with the cooling tower.

13. The sublimation defrost system for the refrigeration apparatus according to claim 1, wherein the refrigerating device is a $NH_3/CO_2$ cascade refrigerating device including:

a primary refrigerant circuit in which $NH_3$ refrigerant circulates and a refrigerating cycle component is disposed; and a secondary refrigerant circuit in which the $CO_2$ refrigerant circulates and a refrigerating cycle component is disposed, the secondary refrigerant circuit led to the cooling device, the secondary refrigerant circuit being connected to the primary refrigerant circuit through a cascade condenser.

14. A sublimation defrost method using the sublimation defrost system for the refrigeration apparatus according to claim 1, the method comprising:

a first step of dehumidifying the freezer inner air in the freezer with the dehumidifier device so that a partial pressure of the water vapor in the freezer inner air does not become a saturated vapor partial pressure;

a second step of closing the on-off valve at the time of defrosting to form the closed circuit;

a third step of adjusting the pressure of the $CO_2$ refrigerant circulating in the closed circuit so that the condensing temperature of the $CO_2$ refrigerant becomes equal to or lower than the freezing point of the water vapor in the freezer inner air in the freezer; and a fourth step of vaporizing the $CO_2$ refrigerant by exchanging heat between the brine as a heating medium and the $CO_2$ refrigerant circulating in the closed circuit; and a fifth step of permitting the $CO_2$ refrigerant vaporized in the fourth step to circulate in the closed circuit, and removing frost attached on an outer surface of the heat exchanger pipe by sublimation with heat of the $CO_2$ refrigerant.

15. A sublimation defrost method for the refrigeration apparatus according to claim 14, wherein in the fourth step, the brine and the $CO_2$ refrigerant circulating in the closed circuit exchange heat in the lower area of the closed circuit provided with a difference in elevation, and in the fifth step, the $CO_2$ refrigerant is permitted to naturally circulate in the closed circuit by a thermosiphon effect.

* * * * *